US011731028B2

(12) United States Patent
Gauvin et al.

(10) Patent No.: US 11,731,028 B2
(45) **Date of Patent: *Aug. 22, 2023**

(54) LEG PAD

(71) Applicant: BAUER HOCKEY LLC, Exeter, NH (US)

(72) Inventors: Anthony Gauvin, Montreal (CA); Thomas Lemelin, Boisbriand (CA); Marco Beauregard, Gore (CA); Jean-François Laperrière, Prévost (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/565,990

(22) Filed: Dec. 30, 2021

(65) Prior Publication Data

US 2022/0226715 A1 Jul. 21, 2022

Related U.S. Application Data

(63) Continuation of application No. 16/438,145, filed on Jun. 11, 2019, now Pat. No. 11,241,609.

(51) Int. Cl.

| | |
|---|---|
| ***A63B 71/12*** | (2006.01) |
| ***A41D 13/06*** | (2006.01) |
| ***A41D 13/05*** | (2006.01) |

(52) U.S. Cl.

CPC ..... *A63B 71/1225* (2013.01); *A41D 13/0543* (2013.01); *A41D 13/065* (2013.01); *A41D 2600/10* (2013.01); *A63B 2071/125* (2013.01); *A63B 2071/1241* (2013.01); *A63B 2071/1258* (2013.01); *A63B 2209/10* (2013.01)

(58) Field of Classification Search

None

See application file for complete search history.

(56) References Cited

U.S. PATENT DOCUMENTS

| | | | |
|---|---|---|---|
| 1,624,129 | A | 4/1927 | Barrett |
| 1,777,088 | A | 9/1930 | Grover |
| 2,982,968 | A | 5/1961 | Groot |
| 3,135,964 | A | 6/1964 | Pender |

(Continued)

FOREIGN PATENT DOCUMENTS

| | | |
|---|---|---|
| CA | 2777785 | 8/2016 |
| CA | 2931819 | 5/2021 |
| EP | 3167731 | 5/2017 |

OTHER PUBLICATIONS

Notice of Allowance dated Jun. 18, 2013 in connection with U.S. Appl. No. 13/475,395, 9 pages.

(Continued)

*Primary Examiner* — Khoa D Huynh
*Assistant Examiner* — Grace Huang

(57) ABSTRACT

A leg pad (e.g., a hockey leg pad) for protecting a leg of a user, in which the leg pad is designed to enhance protection and freedom of movement (e.g., during skating strides), such as by providing flexibility of the leg pad proximate to a knee and optionally an ankle of the user (e.g., for extension and optional retraction of one or more parts of the leg pad) to better follow natural movements of the user's leg (e.g., bending of the knee and optional flexion of the ankle of the user).

13 Claims, 18 Drawing Sheets

(56) References Cited

U.S. PATENT DOCUMENTS

| | | | | |
|---|---|---|---|---|
| 3,761,960 | A | 10/1973 | Woodcock | |
| 3,772,704 | A | 11/1973 | Carbonneau | |
| 4,633,529 | A | 1/1987 | Litz | |
| 4,674,157 | A | 6/1987 | Litz | |
| 4,692,946 | A | 9/1987 | Jurga | |
| 4,698,845 | A | 10/1987 | Cosby | |
| 4,751,748 | A | 6/1988 | Ekins | |
| D297,178 | S | 8/1988 | Jurga | |
| 4,876,745 | A | 10/1989 | Richards | |
| 4,888,826 | A | 12/1989 | Parsons et al. | |
| 5,005,565 | A | 4/1991 | Fratesi | |
| 5,452,475 | A | 9/1995 | Hunt | |
| 5,477,559 | A | 12/1995 | Clement | |
| 5,507,720 | A | 4/1996 | Lampropoulos | |
| 5,594,954 | A | 1/1997 | Huang | |
| 5,662,594 | A | 9/1997 | Rosenblatt | |
| 5,711,028 | A | 1/1998 | Bourque et al. | |
| 5,732,411 | A | 3/1998 | Coleman et al. | |
| 5,742,938 | A | 4/1998 | Winningham et al. | |
| 5,794,261 | A | 8/1998 | Hefling | |
| 5,806,092 | A | 9/1998 | Shikatani | |
| 5,898,939 | A | 5/1999 | Schramm | |
| 6,128,779 | A | 10/2000 | Goldsmith et al. | |
| 6,131,195 | A | 10/2000 | Foreman | |
| 6,178,555 | B1 | 1/2001 | Williams | |
| 6,178,556 | B1 | 1/2001 | Foreman et al. | |
| 6,560,781 | B1 | 5/2003 | Keene et al. | |
| 6,654,961 | B2 | 12/2003 | Beland | |
| 6,687,912 | B2 | 2/2004 | Collins et al. | |
| 6,789,264 | B2 | 9/2004 | Budda | |
| D501,690 | S | 2/2005 | Chen | |
| 6,912,729 | B2 | 7/2005 | Nishimoto | |
| 6,964,062 | B1 | 11/2005 | Chen | |
| 7,188,370 | B2 | 3/2007 | Bevier | |
| 7,797,760 | B2 | 9/2010 | Morrow et al. | |
| 7,797,764 | B2 | 9/2010 | Norris | |
| 7,832,017 | B2 | 11/2010 | Nascimento et al. | |
| 7,841,018 | B2 | 11/2010 | Kotoske | |
| 7,845,017 | B2 | 12/2010 | Godshaw et al. | |
| 7,937,768 | B2 | 5/2011 | Behrend | |
| 8,161,570 | B2 | 4/2012 | McVeigh et al. | |
| 8,510,862 | B1 | 8/2013 | Contant et al. | |
| 9,132,335 | B2 | 9/2015 | Contant et al. | |
| 9,215,898 | B2 | 12/2015 | Clement et al. | |
| 9,440,136 | B2 | 9/2016 | Smith | |
| 10,124,237 | B2 | 11/2018 | Contant et al. | |
| 10,201,196 | B2 * | 2/2019 | Cox | A41D 13/0568 |
| 10,737,168 | B2 | 8/2020 | Contant et al. | |
| 11,202,954 | B2 * | 12/2021 | Runzo | A63B 71/1225 |
| 11,241,609 | B2 * | 2/2022 | Gauvin | A41D 13/065 |
| 2004/0083527 | A1 | 5/2004 | Budda | |
| 2005/0015841 | A1 | 1/2005 | Hoffman | |
| 2005/0246812 | A1 | 11/2005 | Bevier | |
| 2006/0107433 | A1 | 5/2006 | Olson | |
| 2007/0050884 | A1 | 3/2007 | Contant et al. | |
| 2007/0250977 | A1 | 11/2007 | Brown et al. | |
| 2008/0120756 | A1 | 5/2008 | Shepherd | |
| 2009/0025114 | A1 | 1/2009 | Hudon et al. | |
| 2010/0107291 | A1 | 5/2010 | Carter | |
| 2010/0229276 | A1 | 9/2010 | Bevier | |
| 2013/0025017 | A1 | 1/2013 | Chen | |
| 2013/0305424 | A1 | 11/2013 | Contant et al. | |
| 2015/0360116 | A1 | 12/2015 | Contant et al. | |
| 2016/0183609 | A1 | 6/2016 | Cox | |
| 2017/0055603 | A1 | 3/2017 | Guidetti et al. | |
| 2017/0119068 | A1 | 5/2017 | Beckenholdt | |
| 2018/0292177 | A1 | 10/2018 | Roby et al. | |
| 2019/0038956 | A1 | 2/2019 | Contant et al. | |
| 2020/0138125 | A1 | 5/2020 | Beaudry et al. | |
| 2020/0391096 | A1 | 12/2020 | Gauvin et al. | |
| 2021/0046375 | A1 | 2/2021 | Gelbard | |

OTHER PUBLICATIONS

Non-Final Office Action dated Jan. 16, 2015 in connection with U.S. Appl. No. 13/953,251, 10 pages.
Notice of Allowance dated May 11, 2015 in connection with U.S. Appl. No. 13/953,251, 6 pages.
Advisory Action dated Jan. 30, 2018 in connection with U.S. Appl. No. 14/837,598, 3 pages.
Advisory Action dated Jan. 4, 2017 in connection with U.S. Appl. No. 14/837,598, 3 pages.
Final Office Action dated Oct. 14, 2016 in connection with U.S. Appl. No. 14/837,598, 12 pages.
Final Office Action dated Oct. 16, 2017 in connection with U.S. Appl. No. 14/837,598, 34 pages.
Non-Final Office Action dated Apr. 8, 2016 in connection with U.S. Appl. No. 14/837,598, 10 pages.
Non-Final Office Action dated Mar. 7, 2018 in connection with U.S. Appl. No. 14/837,598, 17 pages.
Non-Final Office Action dated Mar. 9, 2017 in connection with U.S. Appl. No. 14/837,598, 30 pages.
Notice of Allowance dated Jul. 12, 2018 in connection with U.S. Appl. No. 14/837,598, 5 pages.
Non-Final Office Action dated Oct. 31, 2019 in connection with U.S. Appl. No. 16/158,747, 19 pages.
Notice of Allowance dated Apr. 8, 2020 in connection with U.S. Appl. No. 16/158,747, 7 pages.
Non-Final Office Action dated Oct. 2, 2020 in connection with U.S. Appl. No. 16/438,145, 45 pages.
Notice of Allowance dated Oct. 5, 2021 in connection with U.S. Appl. No. 16/438,145, 8 pages.
Final Office Action dated Mar. 26, 2021 in connection with U.S. Appl. No. 16/438,145, 36 pages.
Examiner's Report dated Oct. 23, 2014 in connection with Canadian Patent Application No. 2,777,785, 6 pages.
Withdrawal of Examiner's Report dated Nov. 3, 2014 in connection with Canadian Patent Application No. 2,777,785, 1 page.
Examiner's Report dated Nov. 3, 2014 in connection with Canadian Patent Application No. 2,777,785, 6 pages.
Examiner's Report dated Mar. 13, 2015 in connection with Canadian Patent Application No. 2,777,785, 4 pages.
Examiner's Report dated Jul. 22, 2015 in connection with Canadian Patent application No. 2,777,785, 3 pages.
Examiner's Report dated Apr. 3, 2018 in connection with Canadian Patent Application No. 2,931,819, 15 pages.
Examiner's Report dated Oct. 27, 2020 in connection with Canadian Patent Application No. 2,931,819, 3 pages.

* cited by examiner

LEG PAD

CROSS-REFERENCE TO RELATED APPLICATIONS

This application is a continuation of U.S. patent application Ser. No. 16/438,145 filed on Jun. 11, 2019. The contents of the aforementioned application are incorporated by reference herein.

FIELD

This disclosure relates generally to protective equipment and, more particularly, to a leg pad for protecting a leg of a user (e.g., a hockey or other sports player).

BACKGROUND

Protective equipment for sports has been evolving to accommodate a need for increased protection in some situations.

For example, due to a competitive and aggressive nature of some sports, it has often been an objective of sports equipment makers to improve protective gear while permitting flexibility and comfort for users. However, these may be conflicting requirements at times, as an increase in protection can lead to a decrease in flexibility or mobility (e.g., due to rigidity of some protective material).

Leg pads for playing hockey or engaging in other sports or activities may be affected by such conflicting requirements, which may be particularly significant in some cases as impediments to leg movement may affect users' overall mobility.

For at least these and/or other reasons, there is a need for improvements directed to leg pads for protecting users' legs.

SUMMARY

According to various aspects, this disclosure relates to a leg pad (e.g., a hockey leg pad) for protecting a leg of a user, in which the leg pad is designed to enhance protection and freedom of movement (e.g., during skating strides), such as by providing flexibility of the leg pad proximate to a knee and optionally an ankle of the user (e.g., for extension and optional retraction of one or more parts of the leg pad) to better follow natural movements of the user's leg (e.g., bending of the knee and optional flexion of the ankle of the user).

For example, according to one aspect, this disclosure relates to a leg pad for protecting a leg of a user. The leg pad comprises a knee cap configured to cover at least part of a knee of the user. The leg pad also comprises a shin shell configured to cover at least part of a shin of the user and movable relative to the knee cap. An upper half of the shin shell is configured to extend when the leg of the user bends.

According to another aspect, this disclosure relates to a leg pad for protecting a leg of a user. The leg pad comprises a knee cap configured to cover at least part of a knee of the user. The leg pad also comprises a shin shell configured to cover at least part of a shin of the user. The shin shell is movable relative to the knee cap.

The shin shell comprises shell members movable relative to one another when the leg of the user bends and extends. A first one of the shell members and a second one of the shell members are movable relative to one another in an upper half of the shin shell.

According to yet another aspect, this disclosure relates to a leg pad for protecting a leg of a user. The leg pad comprises a knee cap configured to cover at least part of a knee of the user. The leg pad also comprises a shin shell configured to cover at least part of a shin of the user. The shin shell is movable relative to the knee cap and is configured to extend when the knee of the user bends, independent of movement of an ankle of the user.

According to yet a further aspect, this disclosure relates to a leg pad for protecting a leg of a user. The leg pad comprises a knee cap configured to cover at least part of a knee of the user. The leg pad also comprises a shin shell configured to cover at least part of a shin of the user. The shin shell is movable relative to the knee cap. Portions of the shin shell are movable relative to one another when the leg of the user bends and extends such that the knee cap is configured to remain over a patella of the knee of the user when the leg of the user bends.

According to another aspect, this disclosure relates to a leg pad for protecting a leg of a user. The leg pad comprises a knee cap configured to cover at least part of a knee of the user. The leg pad also comprises a shin shell configured to cover at least part of a shin of the user. The shin shell is movable relative to the knee cap and comprises shell members movable relative to one another when the leg of the user bends and extends. A first one of the shell members, a second one of the shell members, and a third one of the shell members are movable relative to one another.

According to another aspect, this disclosure relates to a leg pad for protecting a leg of a user. The leg pad comprises a knee cap configured to cover at least part of a knee of the user. The leg pad also comprises a shin shell configured to cover at least part of a shin of the user. The shin shell is movable relative to the knee cap. When the knee of the user bends and an ankle of the user flexes, an upper portion of the shin shell is configured to extend and a lower portion of the shin shell is configured to retract.

According to yet another aspect, this disclosure relates to a leg pad for protecting a leg of a user. The leg pad extends along a longitudinal axis and comprises a knee cap and a shin shell. The knee cap is configured to cover at least part of a knee of the user. The shin shell is configured to cover at least part of a shin of the user. The shin shell has a first shell member configured to cover a first part of the shin of the user and a second shell member configured to cover a second part of the shin of the user. The second shell member is disposed lower than the first shell member. The second shell member is longer than the first shell member along the longitudinal axis of the leg pad. The second shell member is movable relative to the first shell member when the knee of the user bends.

According to yet another aspect, this disclosure relates to a leg pad for protecting a leg of a user. The leg pad extends along a longitudinal axis and comprises a knee cap and a shin shell. The knee cap is configured to cover at least part of a knee of the user. The shin shell is configured to cover at least part of a shin of the user. The shin shell includes a first shell member configured to cover a first part of the leg of the user, a second shell member configured to cover a second part of the leg of the user and a third shell member configured to cover a third part of the leg of the user. The first, second and third shell members are movable relative to each other when the leg of the user bends and extends.

According to yet another aspect, this disclosure relates to a leg pad for protecting a leg of a user. The leg pad extends along a longitudinal axis and comprises a knee cap and a shin shell. The knee cap is configured to cover at least part of a knee of the user. The shin shell is configured to cover at least part of a shin of the user. The knee cap comprises an upper end, a lower end and a mid-point located between the upper end and the lower end of the knee cap. The shin shell comprises an upper end, a lower end and a mid-point located between the upper end and the lower end of the shin shell. The knee cap and the shin shell are movable relative to each other when the leg of the user bends and extends. A distance between the mid-point of the knee cap and the mid-point of the shin shell is configured to increase when the knee bends.

According to yet another aspect, this disclosure relates to a leg pad for protecting a leg of a user. The leg pad extends along a longitudinal axis and comprises a knee cap and a shin shell. The knee cap is configured to cover at least part of a knee of the user. The shin shell is configured to cover at least part of a shin of the user. The knee cap and the shin shell are rotatable relative to each other about a pivot axis.

The pivot axis is configured to intersect a central portion of the knee of the user when the leg pad is worn on a leg of the user.

According to yet another aspect, this disclosure relates to a leg pad for protecting leg of a user. The leg pad extends along a longitudinal axis and comprises a knee cap and a shin shell. The knee cap is configured to cover at least part of a knee of the user. The shin shell is configured to cover at least part of a shin of the user. The knee cap and the shin shell are rotatable relative to each other about a pivot axis. The pivot axis is configured to move relative to the shin shell when the knee cap and the shin shell rotate relative to one another.

According to yet another aspect, this disclosure relates to a leg pad for protecting a leg of a user. The leg pad extends along a longitudinal axis and comprises a knee cap and a shin shell. The knee cap is configured to cover at least a part of a knee of the user. The shin shell is configured to cover at least a part of a shin of the user. The knee cap and the shin shell are rotatable relative to each other and have a range of motion of at least 10° without exposing a frontal area of at least one of the knee and the shin of the user when the leg pad is worn on a leg of the user.

These and other aspects of this disclosure will now become apparent to those of ordinary skill upon review of a description of embodiments that follows in conjunction with accompanying drawings.

BRIEF DESCRIPTION OF DRAWINGS

A detailed description of embodiments is provided hereinbelow with reference to the following drawings, in which.

It is to be expressly understood that the description and drawings are only for purposes of illustrating certain embodiments and are an aid for understanding. They are not intended to be and should not be limiting.

DETAILED DESCRIPTION OF EMBODIMENTS

Figure 1:
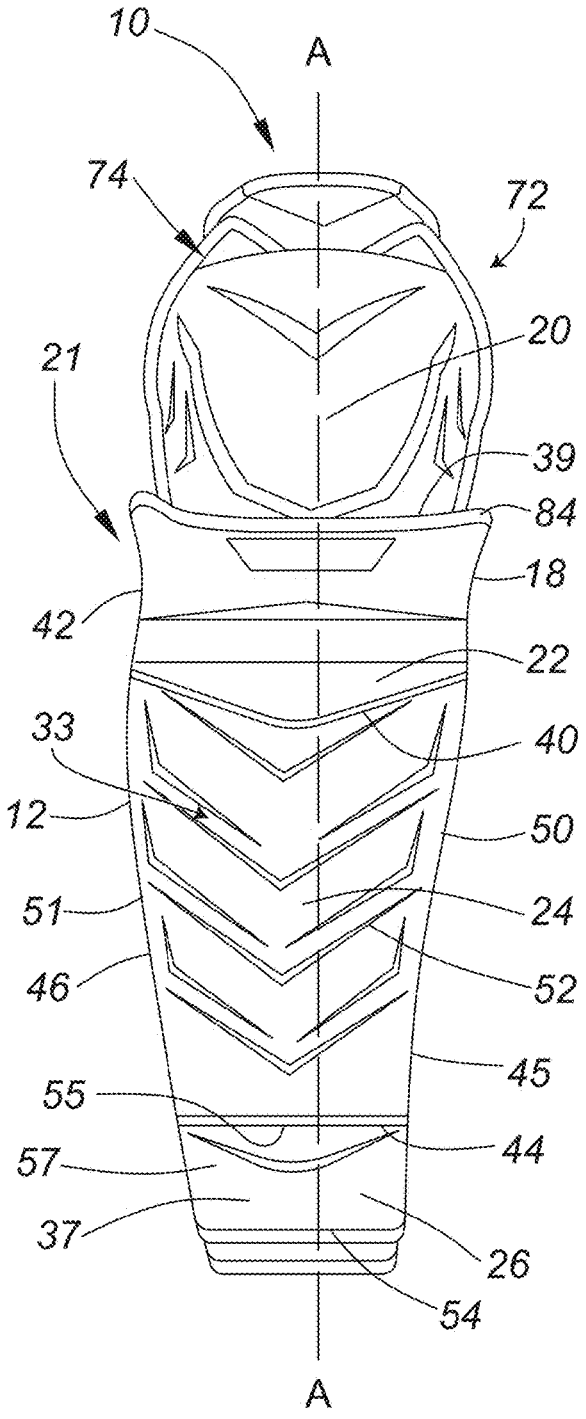
FIG. 1 is a front view of a leg pad in accordance with an embodiment.
Figure 2:
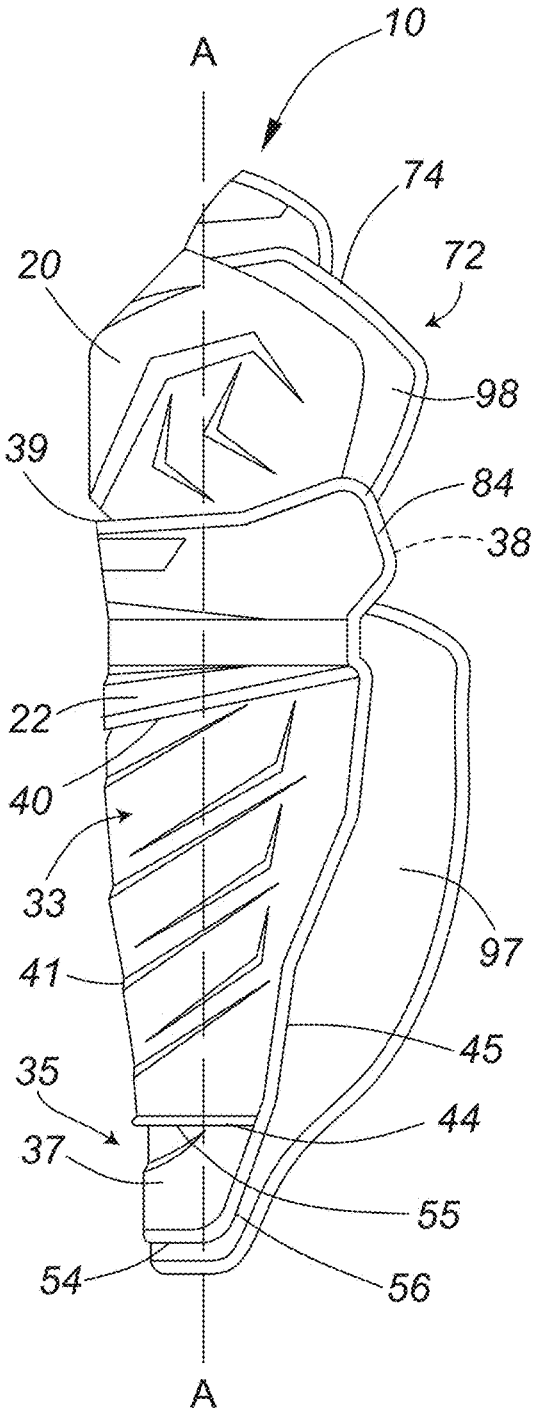
FIG. 2 is a side view of the leg pad of FIG. 1.
Figure 14:
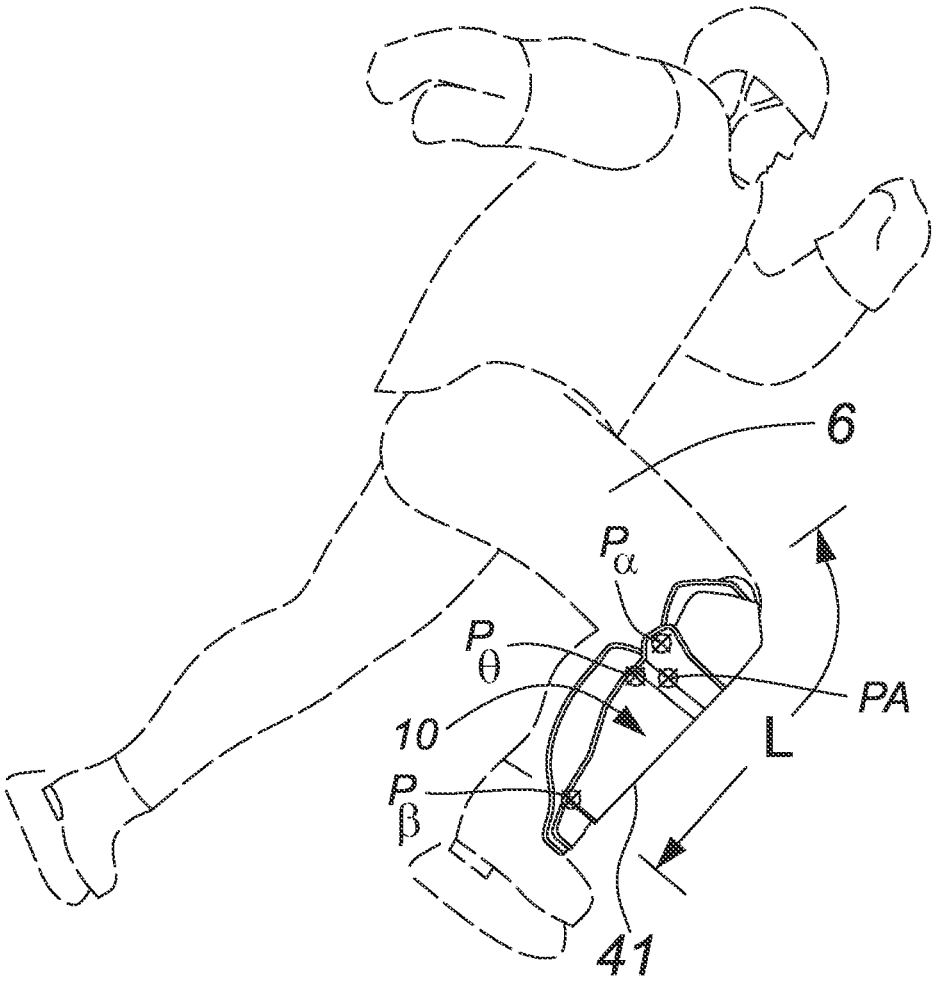
FIG. 14 is a side view of a user in motion, in this example a hockey player during a skating stride.

FIGS. 1 and 14 show an embodiment of a leg pad 10 for protecting a leg 6 of a user engaging in a sport or other activity. In this embodiment, the leg pad 10 is a hockey leg pad (sometimes also referred to as a "shin guard") for use by the user, who is a hockey player, to protect the user's leg 6 against impacts from a puck or ball, a hockey stick, etc. while playing hockey.

Figure 15:
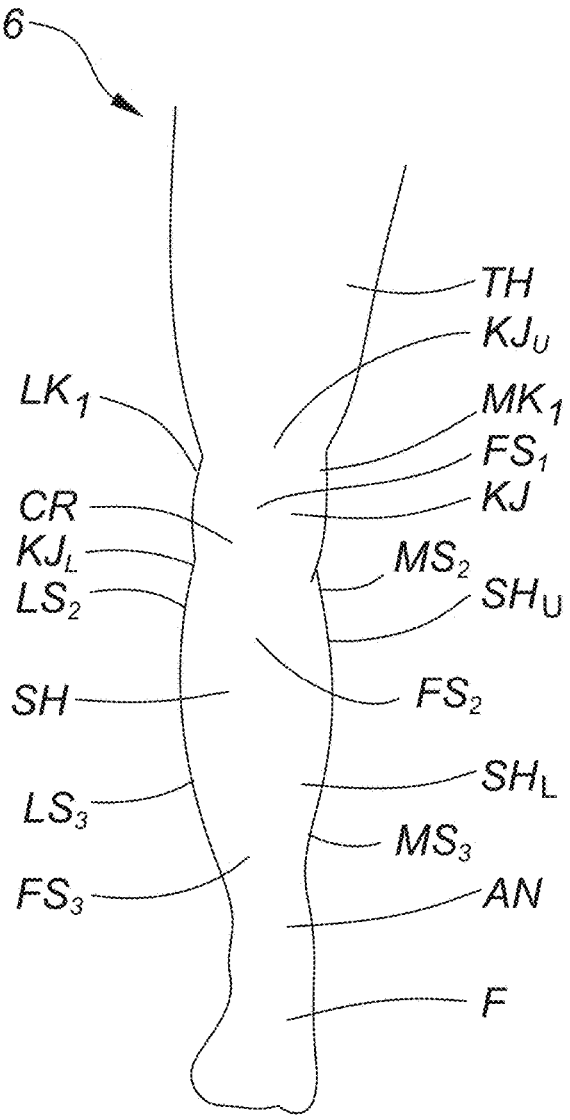
FIGS. 15 and 16 are front views and medial side views of a right leg of the user.
Figure 16:
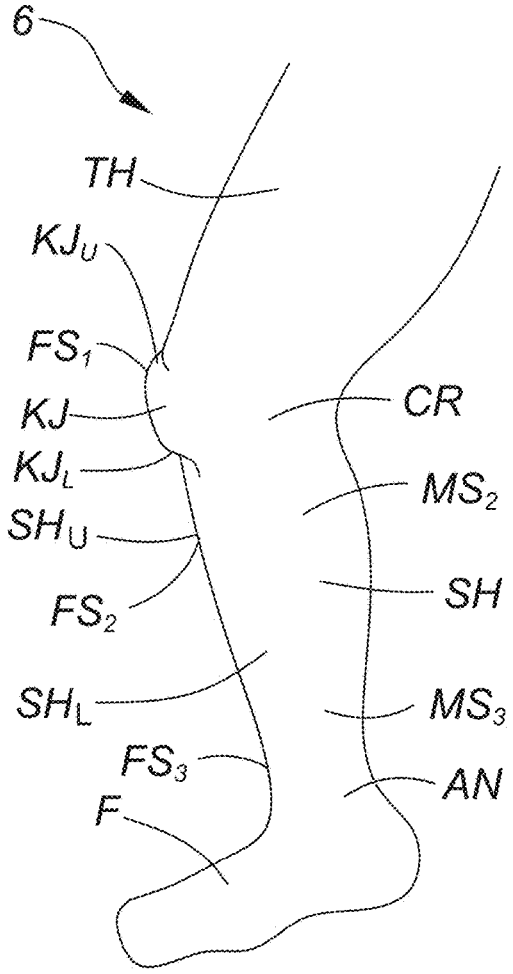

As shown in FIGS. 15 and 16, the user's leg 6 comprises a knee KJ, a shin SH below the knee KJ, a thigh TH, an ankle AN, and a foot F. Each one of the knee KJ, the shin SH, the thigh TH, the ankle AN, and the foot F comprises a medial side and a lateral side. The shin SH comprises an upper part $SH_U$ and a lower part $SH_L$. The knee KJ comprises an upper part KJu and a lower part $KJ_L$. Each one of the knee KJ, the shin SH and the ankle AN comprises a front side and a rear side, while the foot F comprises a dorsal side and a plantar side.

As further discussed later, in this embodiment, the leg pad 10 is designed to enhance protection and freedom of movement, including during skating strides, such as by providing flexibility of the leg pad 10 proximate to the knee KJ and the ankle AN of the user (e.g., for extension and retraction of parts of the leg pad 10) to better follow natural movements of the user's leg 6 (e.g., bending of the knee KJ and flexion of the ankle AN of the user).

As shown in FIG. 1, the leg pad 10 comprises a knee cap 20 configured to cover at least part of the knee KJ of the user and a shin shell 21 configured to cover at least part of the shin SH of the user and movable relative to the knee cap 20 when the user bends his/her leg. In this embodiment, the leg pad 10 comprises a liner 72 disposed behind the knee cap 20 and the shin shell 21.

Figure 4A:
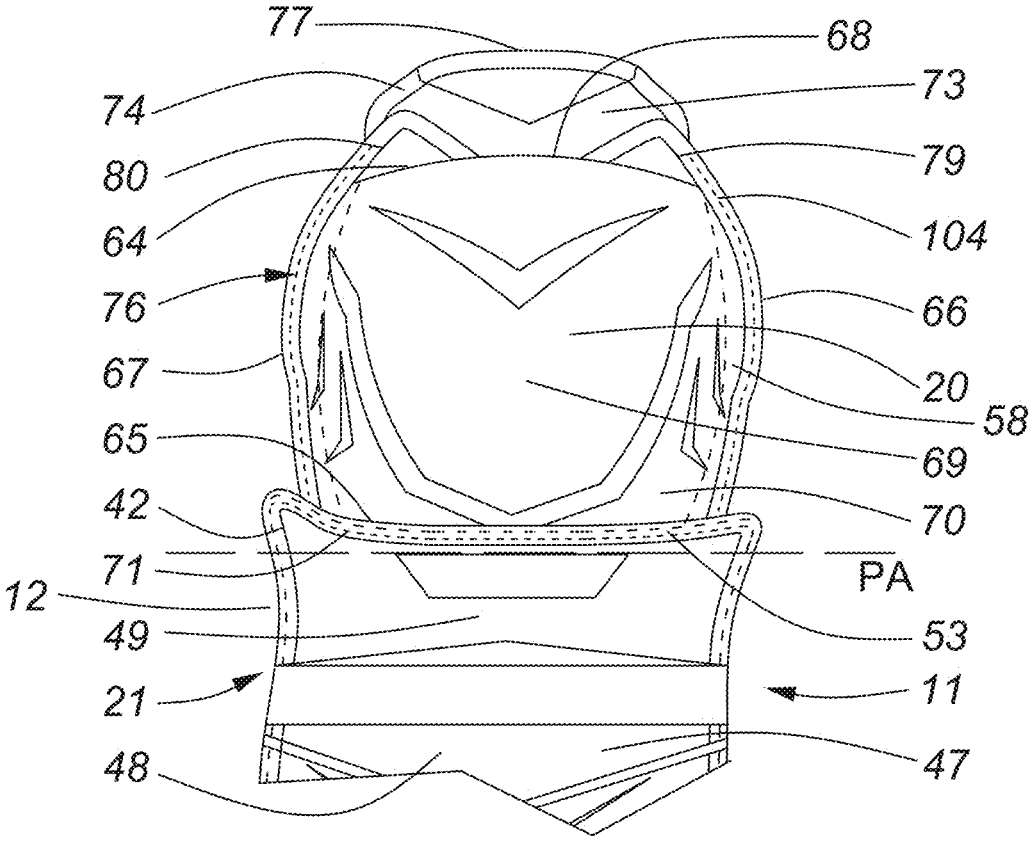
FIG. 4A is an enlarged front view of the knee cap of the leg pad.

Movement of the shin shell 21 relative to the knee cap 20 when the user's leg bends can be viewed as including a pivoting motion, i.e., a rotation, of the shin shell 21 relative to the knee cap 20. In this embodiment, the movement of the shin shell 21 relative to the knee cap 20 also includes a translation of the shin shell 21 relative to the knee cap 20. The movement of the shin shell 21 relative to the knee cap 20 is thus partly rotational and partly translational. As shown in FIG. 4A, a pivot axis PA of the shin shell 21 relative to the knee cap 20 is thus conceptually that axis about which the shin shell 21 pivots relative to the knee cap 20 as part of its movement relative to the knee cap 20. The knee cap 20 and the shin shell 21 pivot about a pivot region Pa. As shown in FIG. 14, in this embodiment, the pivot axis PA of the shin shell 21 relative to the knee cap 20 is located away from a front 41 of the leg pad 10. More particularly, in this embodiment, the pivot axis PA of the shin shell 21 relative to the knee cap 20 is configured to be aligned with a central region CR of the user's knee KJ.

Figure 9A:
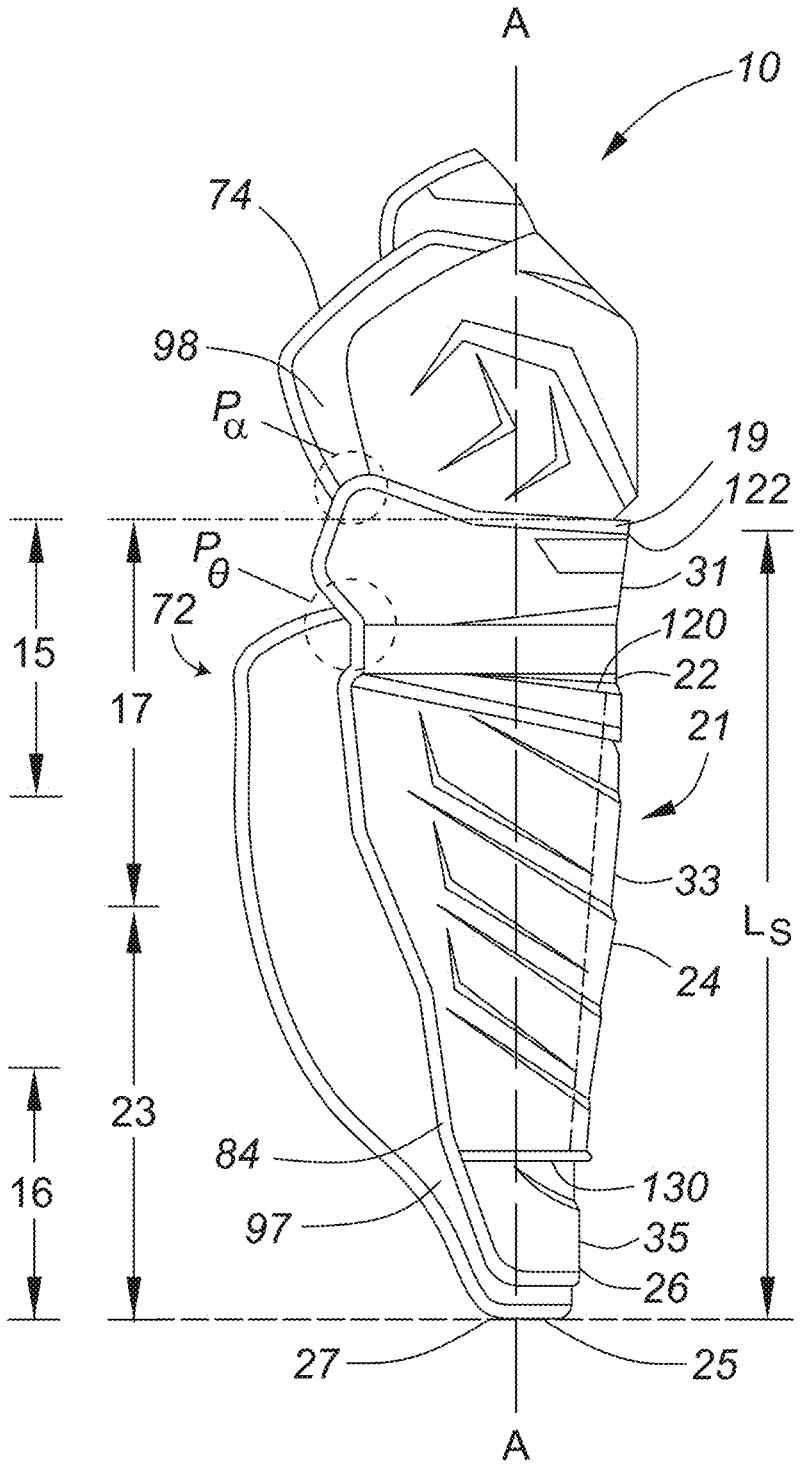
FIG. 9A is an enlarged side view of the shin shell of the leg pad showing the an upper shell member in a first position relative to the intermediate shell member.
Figure 9B:
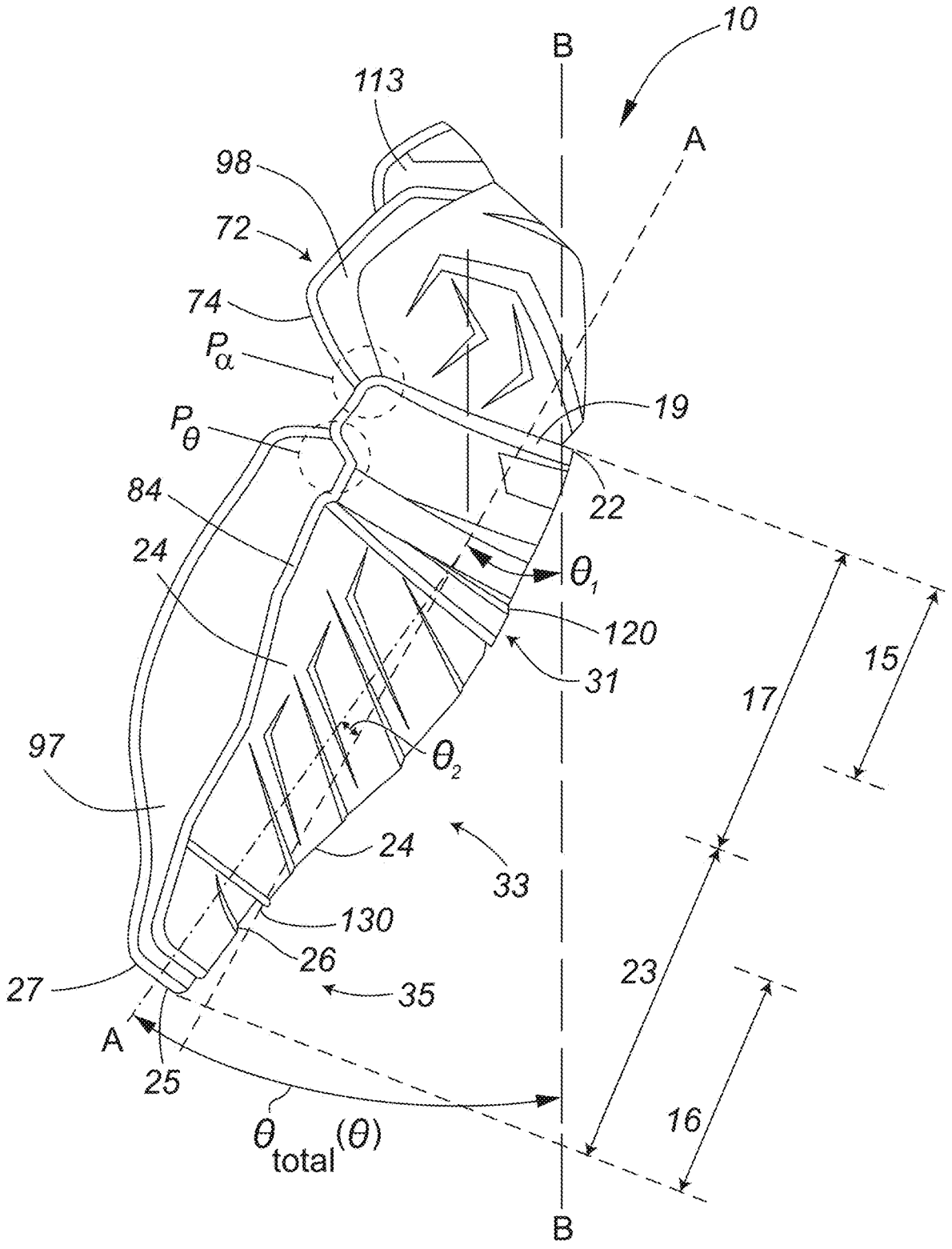
FIG. 9B is an enlarged side view of the shin shell of the leg pad showing the upper shell member in a second position relative to the intermediate shell member.

As best shown in FIGS. 9A and 9B an upper half 17 of the shin shell 21 extends from a top 19 of the shin shell 21 for half of a length $L_s$ of the shin shell 21, which is a longitudinal dimension of the shin shell 21 at rest along a longitudinal axis A-A of the leg pad 10, whereas a lower half 23 of the shin shell 21 extends from a bottom 25 of the shin shell 21 for half of the length $L_s$ of the shin shell 21. An upper third 15 of the shin shell 21 extends from the top 19 of the shin shell 21 for a third of a length $L_s$ of the shin shell, whereas a lower third 16 extends from the bottom 25 of the shin shell 21 for a third of the length $L_s$ of the shin shell 21.

In this embodiment, the shin shell 21 may also cover at least part of a front of the ankle AN of the user such that the bottom 25 of the shin shell 21 is configured to overlie the front of the user's ankle AN.

In this example, as it is a hockey leg pad, the leg pad 10 is free of (i.e., does not have) any instep portion overlying an instep of the user's foot F such that a bottom 27 of the leg pad 10, which corresponds to the bottom 25 of the shin shell 21, is configured to be disposed above the user's foot F to facilitate wearing of a skate on the user's foot F.

In this embodiment, when the user's knee KJ bends and the user's ankle AN flexes, such as during a skating stride, the upper half 17 of the shin shell 21 is configured to extend and the lower half 23 of the shin shell 21 is configured to retract. Moreover, the upper half 17 of the shin shell 21 extends when the knee KJ of the user bends independently of the movement of the ankle AN of the user. In this example, portions 31, 33, 35 of the shin shell 21 are movable relative to one another when the user's leg 6 bends and extends to allow this extension of the upper half 17 of the shin shell 21 and retraction of the lower half 23 of the shin shell 21. In this case, relative motion of adjacent ones of the portions 31, 33, 35 of the shin shell 21, notably of the portions 31, 33 of the shin shell 21 closer to the user's knee KJ, is such that the knee cap 20 is configured to remain over a patella of the user's knee KJ when the knee KJ of the user bends.

More particularly, in this embodiment, the shin shell 21 comprises shell members 22, 24, 26 that are movable relative to one another when the user's leg bends and extends. In this example, the shell members 22, 24, 26 include respective ones of the portions 31, 33, 35 of the shin shell 21 and can respectively be referred to as upper, intermediate, and lower shell members. The upper and intermediate shell members 22, 24 are movable relative to one another in the upper half 17 of the shin shell 21. More specifically, in this example, the upper and intermediate shell members 22, 24 are movable relative to one another in the upper third 15 of the shin shell 21. As such, the upper third 15 of the shin shell 21 is configured to extend when the leg 6 of the user bends.

Also, in this embodiment, the intermediate and lower shell members 24, 26 are movable relative to one another in the lower half 23 of the shin shell 21. More specifically, the intermediate and lower shell members 24, 26 are movable relative to one another in the lower third 16 of the shin shell 21.

Figure 11A:
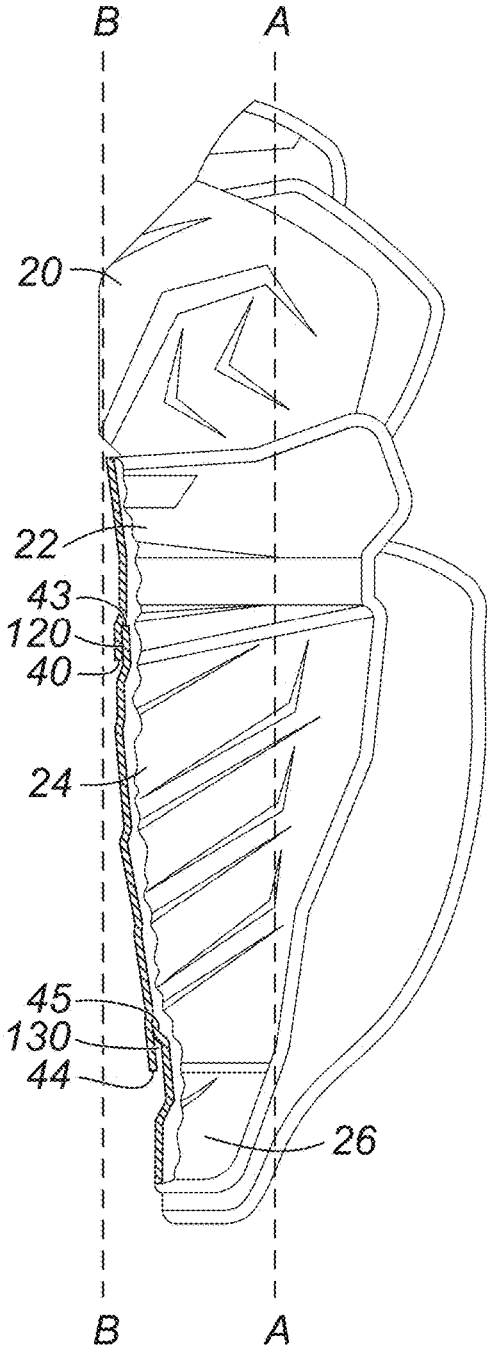
FIG. 11A is a side view of the leg pad showing a partial cross section of the shin shell of the leg pad and the intermediate shell member in the first position.
Figure 11B:
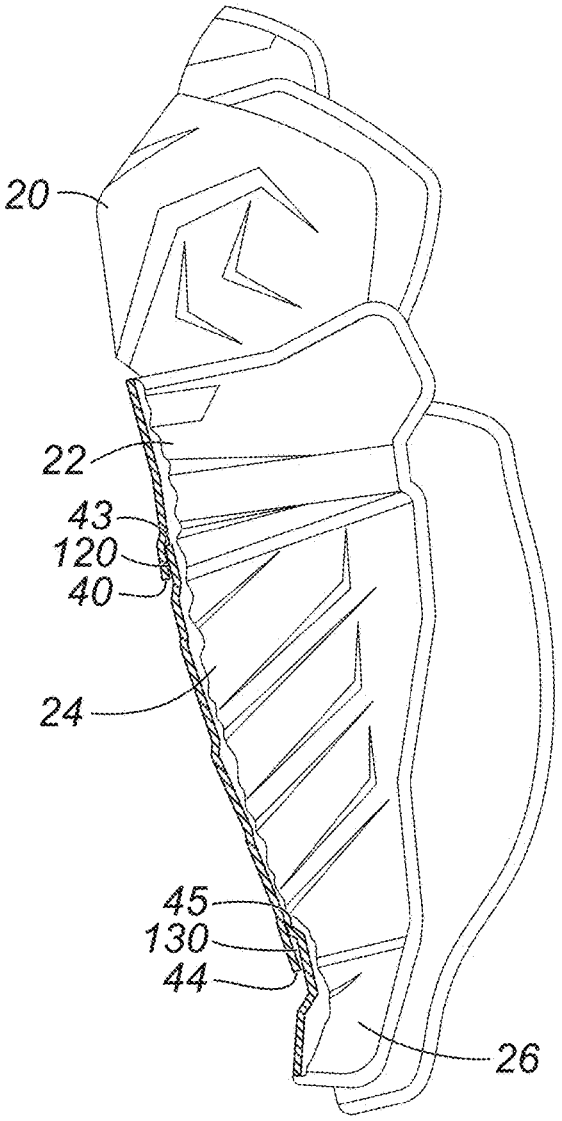
FIG. 11B is a side view of the leg pad showing a partial cross section of the shin shell of the leg pad and the intermediate shell member in the second position.

An overlap 120 exists between the upper shell member 22 and the intermediate shell member 24 and is configured to decrease when the leg 6 of the user bends. The upper shell member 22 and the intermediate shell member 24 overlap when the upper shell member 22 is in a rest position relative to the intermediate shell member 24 as shown in FIG. 11A. The overlap 120 between the upper shell member 22 and the intermediate shell member 24 is configured to decrease when the leg 6 of the user bends. Furthermore, an overlap 130 between the intermediate shell member 24 and the lower shell member 26 is configured to increase when the leg 6 of the user bends and the ankle AN of the user flexes. The intermediate shell member 24 and the lower shell member 26 are also configured to overlap one another when the leg 6 of the user is straight.

The upper shell member 22 and the intermediate shell member 24 are configured to avoid an exposed gap therebetween over a range of relative motion thereof. The upper shell member 22 is biased towards its rest position relative to the intermediate shell member 24. The upper shell member 22 and the intermediate shell member 24 are configured to avoid an exposed gap therebetween over a range of relative motion thereof. The intermediate shell member 24 and the lower shell member 26 are configured to avoid an exposed gap therebetween over a range of relative motion thereof. The lower shell member 26 is biased towards its rest position relative to the intermediate shell member 24.

In this embodiment, a band 84 is disposed about at least part of a periphery of the upper shell member 22 and the intermediate shell member 24 to interconnect the upper shell member 22 and the intermediate shell member 24. The band allows the upper shell member 22 and the intermediate shell member 24 to move relative to one another. Also, in this embodiment, the band 84 is disposed about at least part of the periphery of the intermediate shell member 24 and the lower shell member 26 to interconnect the intermediate shell member 24 and the lower shell member 26 and allow the intermediate shell member 24 and the lower shell member 26 to move relative to one another. Thus, in this embodiment, the band 84 extends continuously to interconnect the upper, intermediate and lower shell members 22, 24, 26 while allowing their relative motions.

In this embodiment, the liner 72 is disposed behind the shell members 22, 24, 26 and extends across adjacent ones of the shell members 22, 24, 26. In this example, the liner 72 also lies behind the knee cap 20.

More particularly, in this embodiment, the liner 72 comprises a liner member 97 disposed behind the shell members 22, 24, 26 and extends across adjacent ones of the shell members 22, 24, 26, and a liner member 98 separate from the liner member 97 and disposed behind the knee cap 20.

Figure 3A:
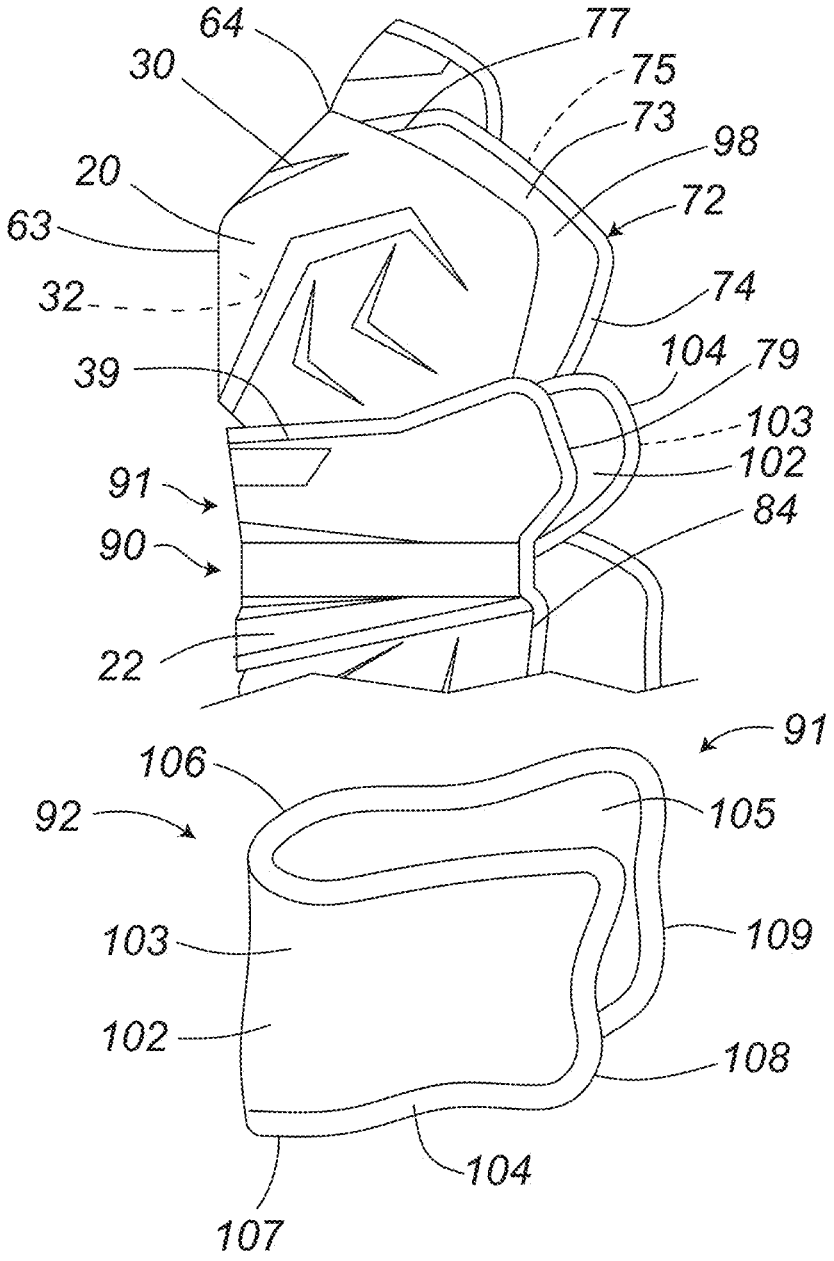
FIG. 3A is an enlarged exploded perspective view of a knee cap of the leg pad.
Figure 3B:
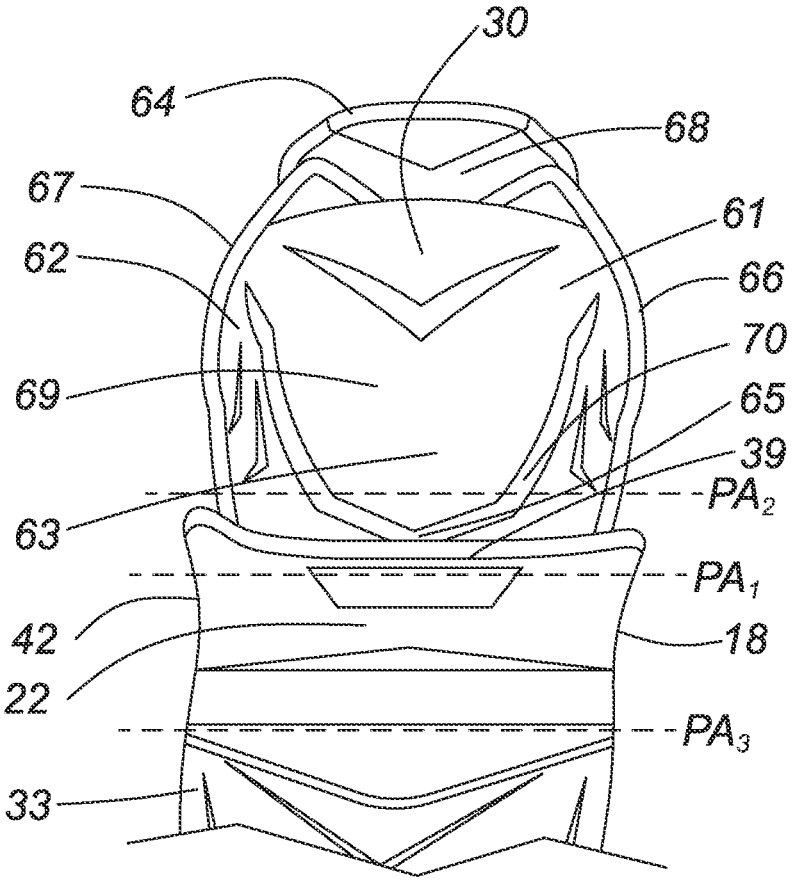
FIG. 3B is an enlarged exploded front view of the knee cap of the leg pad.

With additional reference to FIGS. 3A and 3B, in this embodiment, the knee cap 20 comprises an outer side 30 and an inner side 32 opposite to the outer side 30.

Also, in this embodiment, the knee cap 20 comprises a top edge 64, a bottom edge 65, a medial edge 66 and a lateral edge 67. The knee cap 20 may also comprise an upper end 68, a lower end 70 and a mid-point 69 located between the upper end 68 and the lower end 70 of the knee cap 20. The knee cap 20 may cover the knee KJ of the user's leg 6 such that it may protect the knee KJ of the user's leg 6. The knee cap 20 comprises a medial portion 61 for protecting a medial side $MK_1$ of the knee KJ of the user, a lateral portion 62 for protecting a lateral side $LK_1$ of the knee KJ of the user and a front portion 63 for protecting a front side $FS_1$ of the knee KJ of the user.

The knee cap 20 may be made of a rigid polymeric material for providing adequate protection in case of impact with a stick, a puck, or collisions with another user for example. It is known in the art that hockey leg shells can be made of nylon, polycarbonate materials, thermoplastics, thermosetting resins, polyethylene, high density polyethylene (HDPE), polypropylene or any other suitable material. In certain embodiments, the material may have a modulus of elasticity of at least 1000 MPa, in some cases at least 2500 MPa, and in some cases at least 4000 MPa. The knee cap 20 may comprise a material having a hardness in some cases of at least Shore 40D, in some cases at least Shore 60D, or in some cases at least Shore 80D. Other values and ranges for the modulus of elasticity and the hardness of knee cap 20 are possible.

In one embodiment, the knee cap 20 may be formed of the same material. In another embodiment, the knee cap 20 may be formed of different materials. In yet another embodiment the knee cap 20 may comprise a combination of at least two materials. In yet a further embodiment, the material may be a composite material. The knee cap 20 may be manufactured or shaped via any method that is known in the art. For example, the knee cap 20 may be molded or thermoformed. In another embodiment, the knee cap 20 may include at least one cavity which may provide ventilation to the inner side 32 of the knee cap 20.

Figure 4B:
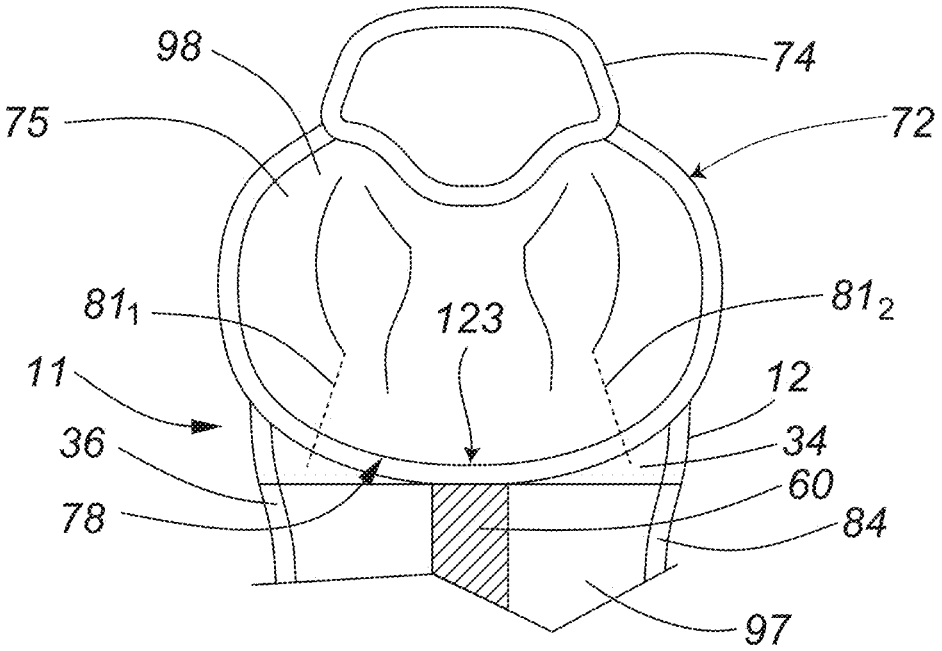
FIG. 4B is an enlarged rear view of the knee cap of the leg pad.
Figure 4C:
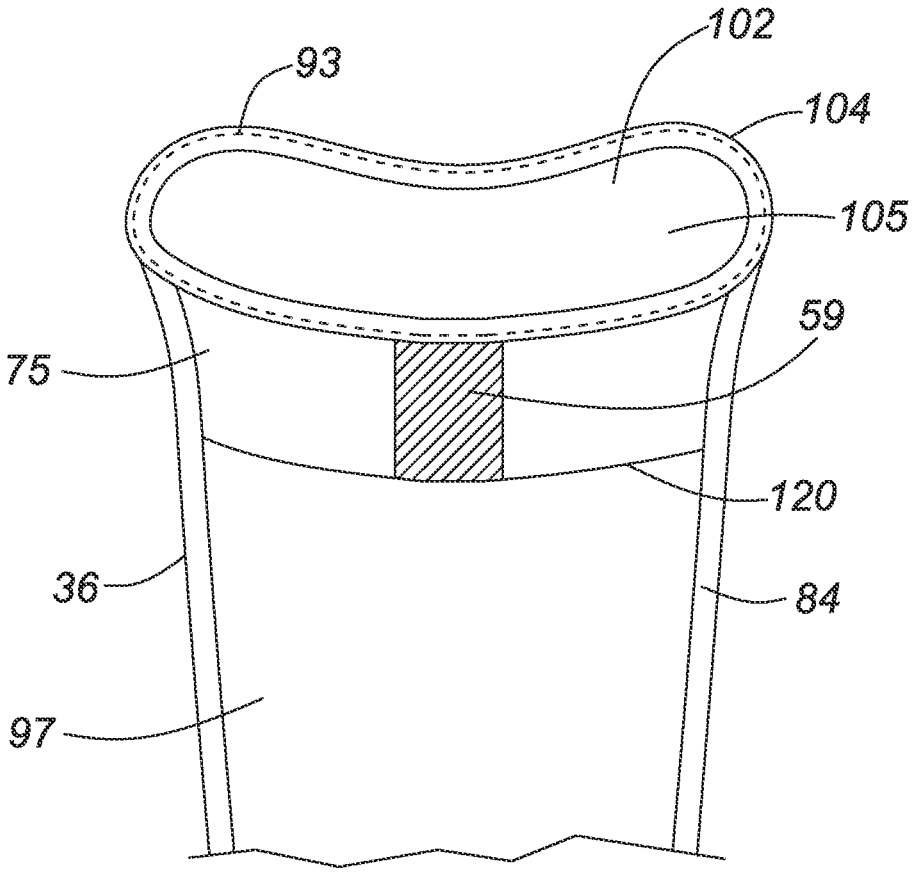
FIG. 4C is an enlarged rear view of a portion of a shin shell of the leg pad.

The liner member 98 is mounted under the knee cap 20 and is adapted to be disposed between knee cap 20 and the user's knee KJ. As shown in FIGS. 4A and 4B, in this embodiment, the liner member 98 comprises an outer side 73 and an inner side 75, the outer side 73 being opposed to the inner side 75. Also, in this embodiment, the liner member 98 comprises a top edge 77, a bottom edge 78, a medial edge 79 and a lateral edge 80.

The liner member 98 may be made of any suitable material or composition or materials that provide the degree of cushioning and protection that is desired. The liner member 98 may be made of a soft material such as foam, polyethylene, low density polyethylene (LDPE) or any other suitable material. The liner member 98 may also be made of foam material covered by layers of woven synthetic yarn, such as closed cell foam of ethylene vinyl acetate covered by a mesh outer layer of a woven synthetic material such as polyester. Such materials would conform itself to the anatomy of the user and may dampen any blows that might occur on the knee cap 20. The liner member 98 may also be slightly oversized with respect to the knee cap 20 such that the liner member 98 may further envelop and protect areas of the user's leg that are not substantially covered by the knee cap 20. It is understood that the liner member 98 may be omitted if the knee cap 20 is made, for example, of a rigid outer layer and a soft inner layer affixed to the rigid outer layer.

In this embodiment, a band 74 extends along part of a periphery of the liner member 98. In some embodiments, the band 74 extends along the entire periphery of the liner member 98. In other embodiments, the band 74 may extend along a portion (i.e. less than an entirety) of the liner member 98.

The band 74 may be a strip of fabric such as a woven stretchable fabric. The band 74 may also be a braiding. As shown in FIGS. 4A and 4B, the band 74 is wide enough to cover a portion of the outer and inner sides 73, 75 and the edges 77, 78, 79, 80 of the liner member 98.

The leg pad 10 may comprise a stitching line 76 passing through the band 74 and the liner member 98 in order to affix the band 74 to the liner member 98.

It is however understood that the affixation of the band 74 to the liner member 98 is not limited to such stitching. For example, in another embodiment, the band 74 may be affixed to the liner member 98 via an adhesive or any other affixing means known in the art.

The leg pad 10 may also comprise a stitching line 58 passing through the knee cap 20 and the liner member 98 in order to affix the knee cap 20 to the liner member 98. It is however understood that the affixation of the knee cap 20 to the liner member 98 is not limited to such stitching. For example, in another embodiment, the knee cap 20 may be affixed to the liner member 98 via an adhesive or any other affixing means known in the art.

With reference to FIGS. 5 to 8B, the upper shell member 22, the intermediate shell member 24 and the lower shell member 26 are shown in more detail.

In this embodiment, the upper shell member 22 may have an outer side 94 and an inner side 34, the outer side 94 being opposed to the inner side 34. The upper shell member 22 may also comprise a top edge 39, a bottom edge 40, a medial edge 18 and a lateral edge 42. The upper shell member 22 may protect an upper part $SH_U$ of a shin SH of a user's leg 6 and may protect a lower part $KJ_L$ of a knee KJ of the user's leg 6.

The upper shell member 22 may comprise a medial portion 47 for protecting a medial side $MS_2$ of the upper part $SH_U$ of the shin SH of the user, a lateral portion 48 for protecting a lateral side $LS_2$ of the upper part $SH_U$ of the shin SH of the user and a front portion 49 for protecting a front side $FS_2$ of the upper part $SH_U$ of the shin SH of the user.

Also, in this embodiment, the intermediate shell member 24 may have an outer side 13 and an inner side 36, the outer side 13 being opposed to the inner side 36. The intermediate shell member 24 may also comprise a top edge 43, a bottom edge 44, a medial edge 45 and a lateral edge 46. The lower shell member 26 may cover a lower part $SH_L$ of the shin of the user. The intermediate shell member 24 may protect a substantial part of the shin SH. In some cases, the lower part $SH_L$ of the shin SH may extend over at least 25% of the length of the shin SH, in some cases over at least 33% of the length of the shin, in some cases over at least a majority of the length of the shin SH, and in some cases over an entirety of a length of the shin SH.

The intermediate shell member 24 may comprise a medial portion 50 for protecting a medial side $MS_3$ of the lower part $SH_L$ of shin SH of the user, a lateral portion 51 for protecting a lateral side $LS_3$ of the lower part $SH_L$ of shin SH of the user and a front portion 52 for protecting a front side $FS_3$ of the lower part $SH_L$ of the shin SH of the user.

The intermediate shell member 24 may also comprise an upper end 121, a lower end 29 and a mid-point 28 located between the upper end 121 and the lower end 29 of the intermediate shell member 24.

Also, in this embodiment, the lower shell member 26 may have an outer side 37 and an inner side 38, the outer side 37 being opposed to the inner side 38. The lower shell member 26 comprises a top edge 55, a bottom edge 54, a medial edge 56 and a lateral edge 57. The lower shell member 26 may protect an ankle portion AN of a user's leg 6. More specifically, the lower shell member 26 covers the lower front part of the user's ankle AN and may also cover the user's forefoot.

The upper, intermediate and lower shell members 22, 24, 26 may be made of a rigid polymeric material for providing adequate protection in case of impact with a stick, a puck, or collisions with another user for example. It is known in the art that hockey leg shells can be made of nylon, polycarbonate materials, thermoplastics, thermosetting resins, polyethylene, high density polyethylene (HDPE), polypropylene or any other suitable material. In certain embodiments, the material may have a modulus of elasticity of at least 1000 MPa, in some cases at least 2500 MPa, and in some cases at least 4000 MPa. The upper, intermediate and lower shell members 22, 24, 26 may comprise a material having a hardness in some cases of at least Shore 40D, in some cases at least Shore 60D, or in some cases at least Shore 80D. Other values and ranges for the modulus of elasticity and the hardness of the upper, intermediate and lower shell members 22, 24, 26 are possible.

In one embodiment, the upper shell member 22, the intermediate shell member 24 and the lower shell member 26 may each be formed of the same material. In another embodiment, the upper shell member 22, the intermediate shell member 24 and the lower shell member 26 may each be formed of different materials. In yet another embodiment the upper shell member 22, the intermediate shell member 24 and the lower shell member 26 may each comprise a combination of at least two materials. In yet another embodiment, the material may be a composite material. The upper, intermediate and lower shell members 22, 24, 26 may be manufactured or shaped via any method that is known in the art. For example, the upper, intermediate and lower shell members 22, 24, 26 may be molded or thermoformed.

Figure 5:
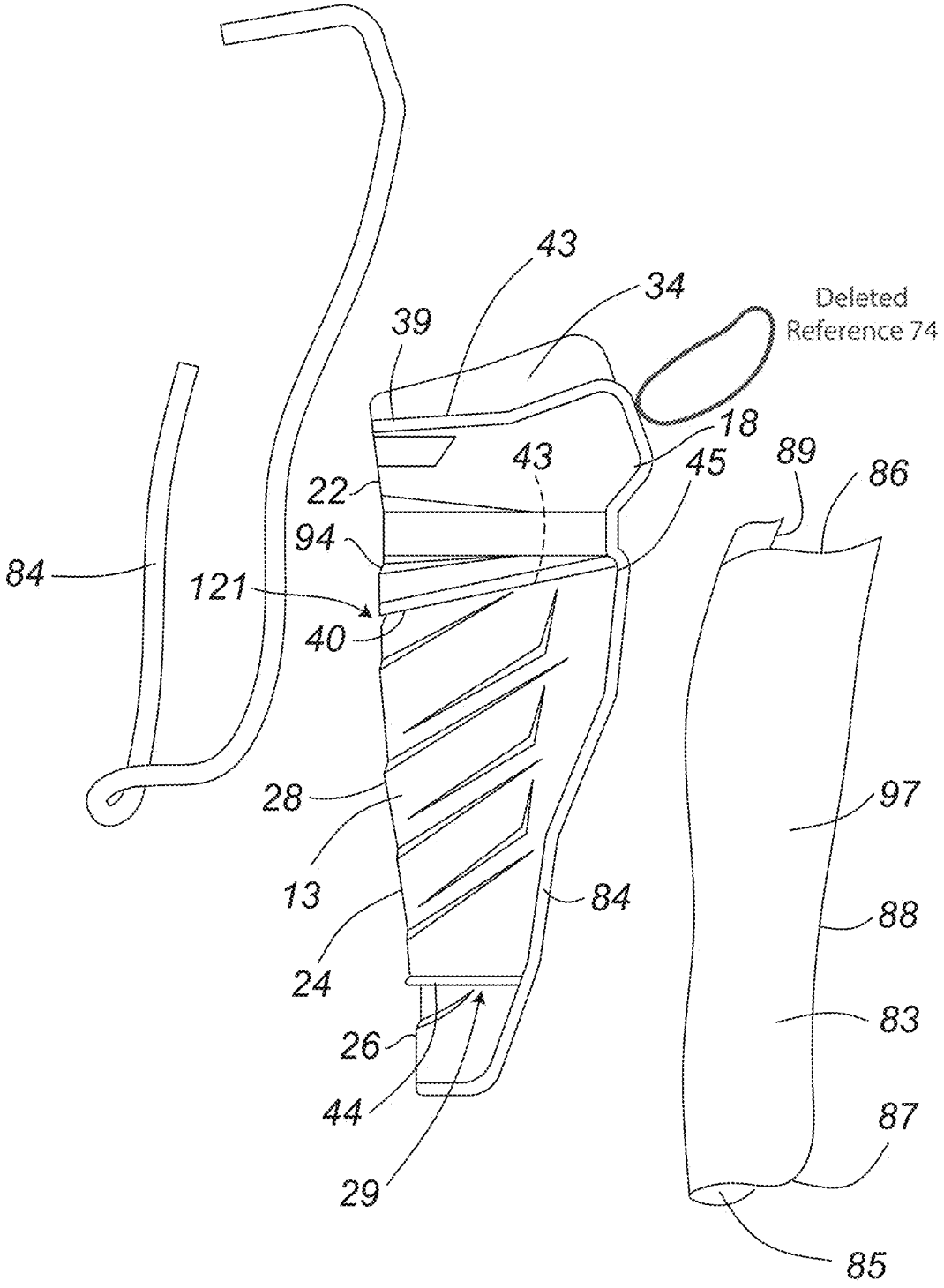
FIG. 5 is an enlarged exploded perspective view of a shin shell of the leg pad.

In this embodiment, the leg pad 10 comprises a liner member 97 and a band 84. The liner member 97 is mounted under the upper, intermediate and lower shell members 22, 24, 26 and is adapted to be disposed between the upper, intermediate and lower shell members 22, 24, 26 and the user's lower knee KJ, shin SH and ankle AN. As shown in FIG. 5, in this embodiment, the liner member 97 may comprise an outer side 83 and an inner side 85, the outer side 83 being opposed to the inner side 85. Also, in this embodiment, the liner member 97 may comprise a top edge 86, a bottom edge 87, a medial edge 88 and a lateral edge 89. The liner member 97 may be made of any suitable material or composition or materials that provide the degree of cushioning and protection that is desired. The liner member 97 may be made of a soft material such as foam, polyethylene, low density polyethylene (LDPE) or any other suitable material. The liner member 97 may also be made of foam material covered by layers of woven synthetic yarn, such as closed cell foam of ethylene vinyl acetate covered by a mesh outer layer of a woven synthetic material such as polyester. Such materials would conform itself to the anatomy of the user and may dampen any blows that might occur on upper, intermediate and/or lower shell members 22, 24, 26. The liner member 97 may also be slightly oversized with respect to the upper, intermediate and lower shell members 22, 24, 26 such that the liner member 97 may further envelop and protect areas of the user's leg 6 that are not substantially covered by the upper, intermediate and lower shell members 22, 24, 26. It is understood that the liner member 97 may be omitted if the upper, intermediate and lower shell members 22, 24, 26 are made, for example, of a rigid outer layer and a soft inner layer affixed to the rigid outer layer.

In this embodiment, the band 84 extends along part of a periphery of the upper shell member 22, part of a periphery of the intermediate shell member 24 and part of a periphery of the lower shell member 26, the band 84 interconnecting the upper, intermediate and/or lower shell members 22, 24, 26 to one another. In some embodiments, the band 84 extends along the entire periphery of the assembled upper, intermediate and/or lower shell members 22, 24, 26. In other embodiments, the band 84 may extend along a portion (i.e. less than an entirety) of the peripheries of the upper, intermediate and/or lower shell members 22, 24, 26.

Figure 6A:
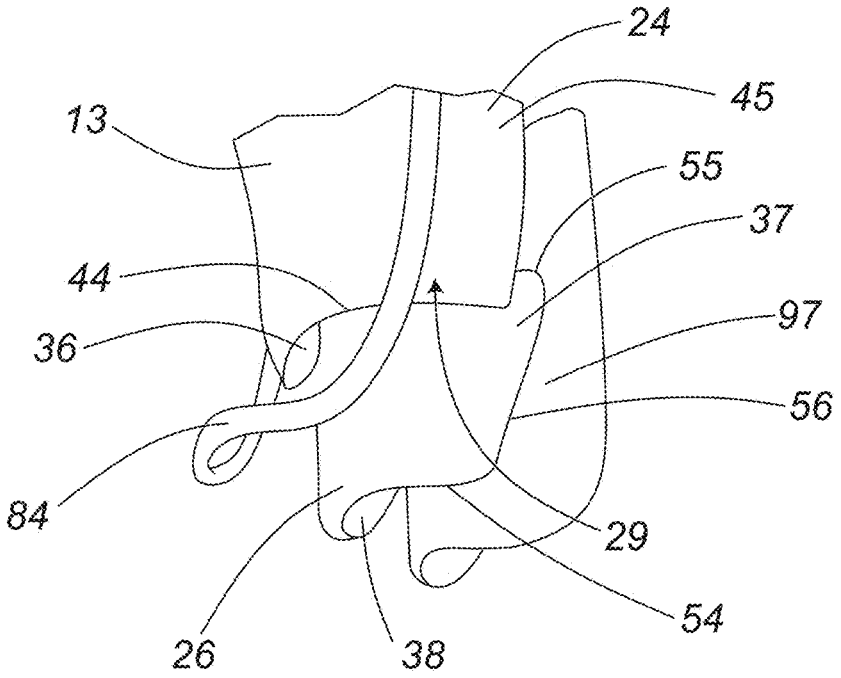
FIG. 6A is an enlarged exploded perspective view of the shin shell of the leg pad.
Figure 6B:
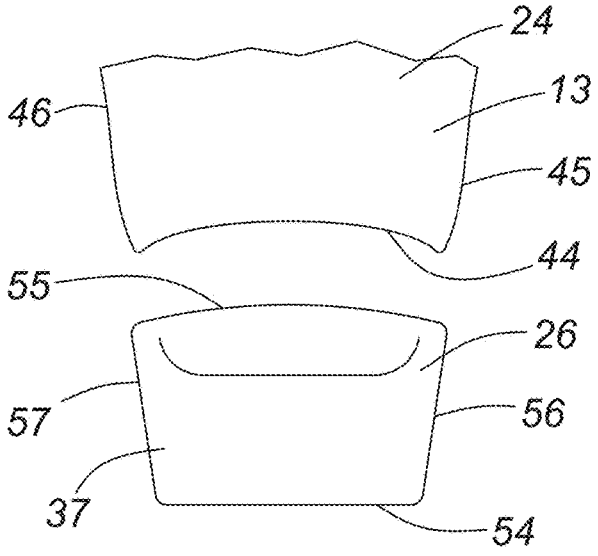
FIG. 6B is an enlarged exploded front view of the shin shell of the leg pad.
Figure 6C:
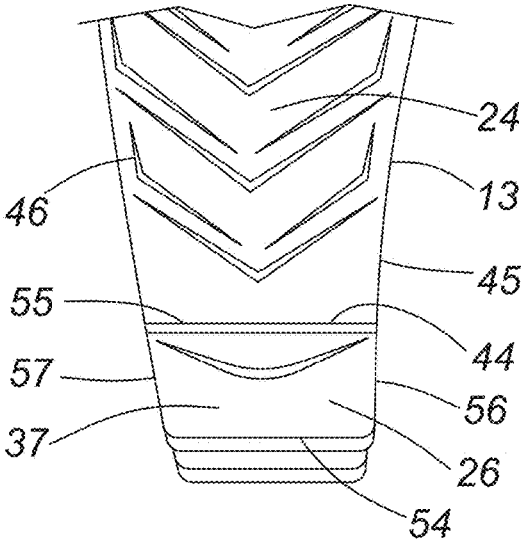
FIG. 6C is an enlarged front view of the shin shell of the leg pad.
Figure 7A:
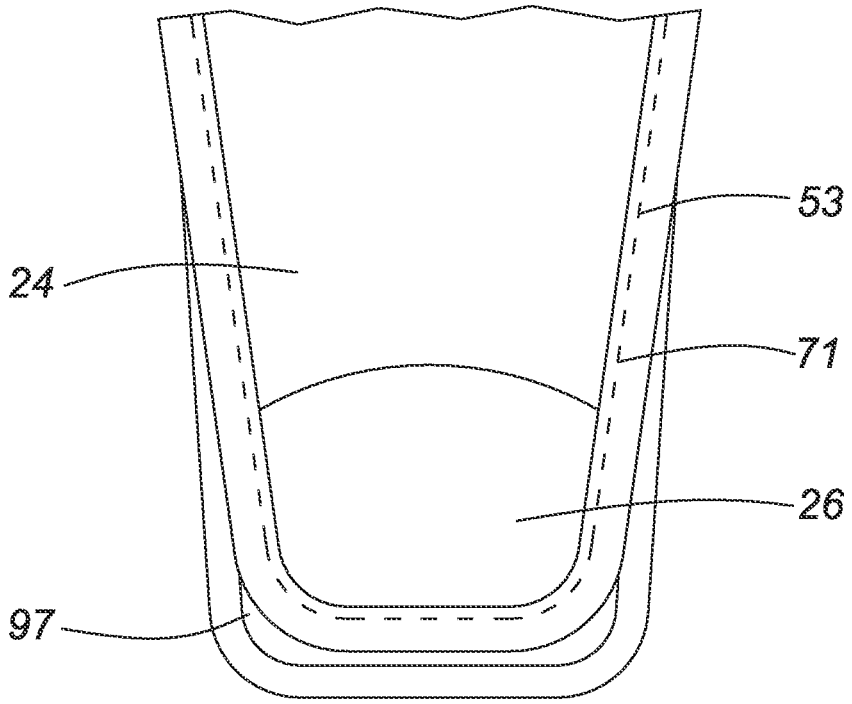
FIG. 7A is an enlarged front view of the shin shell of the leg pad.
Figure 7B:
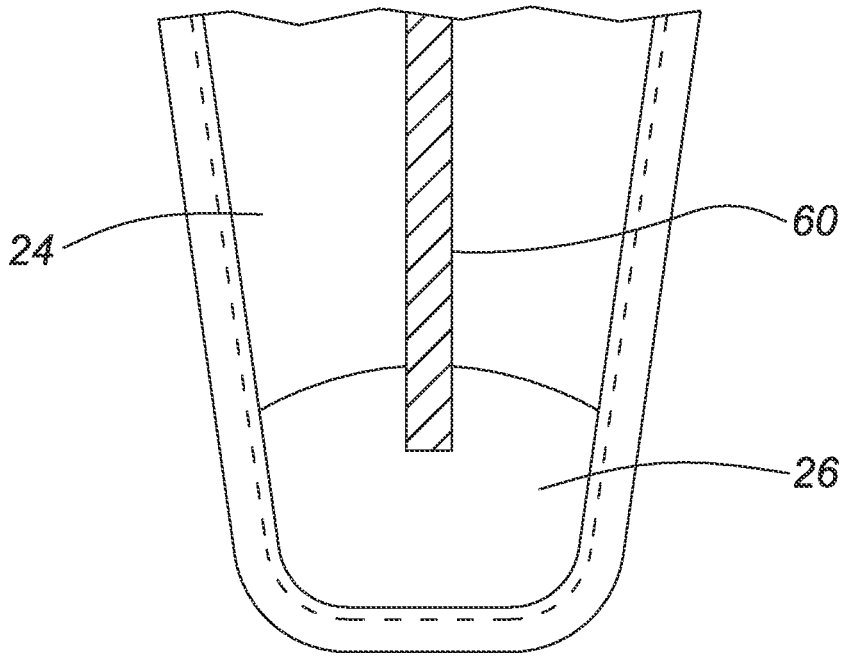
FIG. 7B is an enlarged rear view of the shin shell of the leg pad.

The band 84 may be a strip of fabric such as a woven stretchable fabric. The band 84 may also be a braiding. The band 84 may have a width large enough to cover at least partially the outer and inner sides and edges of the upper, intermediate and/or lower shell members 22, 24, 26. As shown in FIGS. 5 and 6A, the band 84 is wide enough to cover a portion of the outer and inner sides 94, 34 and the top, medial and lateral edges 39, 18, 42 of the upper shell member 22. Furthermore, the band 84 is wide enough to cover a portion of the outer and inner sides 13, 36 and the medial and lateral edges 45, 46 of the intermediate shell member 24. The band is also wide enough to cover a portion of the outer and inner sides 37, 38 and the bottom, medial and lateral edges 54, 56, 57 of the lower shell member 26. Moreover, as best shown in FIG. 5, the bottom edge 40 of the upper shell member 22, the top and bottom edges 43, 44 of the intermediate shell member 24 and the top edge 55 of the lower shell member 26 are free of the band 84 such that these edges may move relative to one another.

The leg pad 10 may comprise a stitching line 53 passing through the band 84 and the upper shell member 22, passing through the band 84 and the intermediate shell member 24 and, passing through the band 84 and the lower shell member 26 in order to affix the band 84 to the upper, intermediate and/or lower shell members 22, 24, 26 such that the band 84 interconnects the upper, intermediate and/or lower shell members 22, 24, 26 to one another.

It is however understood that the affixation of the band 84 to the upper shell member 22, the intermediate shell member 24 and the lower shell member 26 is not limited to such stitching. For example, in another embodiment, the band 84 may be affixed to the upper shell member 22, the intermediate shell member 24 and the lower shell member 26 via an adhesive or any other affixing means known in the art.

Furthermore, the band 84 may be attached to the peripheries of the upper shell member 22 and the intermediate shell member 24 such that the band 84 biases the intermediate shell member 24 towards the first position. Such a bias would avoid that the intermediate shell member 24 undesirably remain in the second position even after the user has extended his/her knee KJ.

Furthermore, the band 84 may be attached to the peripheries of the intermediate shell member 24 and the lower shell member 26 such that the band 84 biases the lower shell member 26 towards the first position. Such a bias would avoid that the lower shell member 26 undesirably remain in the second position even after the user has extended his/her foot F.

The leg pad 10 may also comprise a stitching line 71 passing through the band 84 and the upper shell member 22 and liner member 97, passing through the band 84, the intermediate shell member 24 and liner member 97 and, passing through the band 84, the lower shell member 26 and liner member 97 in order to affix the assembled upper shell member 22, intermediate shell member 24 and lower shell member 26 to the liner member 97 such that the band 84 also interconnects the upper, intermediate and lower shell members 22, 24, 26 and the liner member 97.

The knee cap 20 and the upper shell member 22 are rotatable relative to each other about a pivot axis $PA_1$. The pivot axis $PA_1$ is configured to intersect a lateral portion of the knee KJ of the user when the leg pad 10 is worn on a leg 6 of the user. The knee cap 20 and the upper shell member 22 have a range of motion of at least 10° without exposing a frontal area of at least one of the knee KJ and the shin SH of the user when the leg pad 10 is worn on the leg 6 of the user. In other embodiments, the range of motion may be at least 15° without exposing a frontal area of at least one of the knee KJ and the shin SH of the user when the leg pad 10 is worn on the leg 6 of the user. In other embodiments, the range of motion of at least 20° without exposing a frontal area of at least one of the knee KJ and the shin SH of the user when the leg pad 10 is worn on the leg 6 of the user.

The knee cap 20 and the intermediate shell member 24 are movable relative to each other; and a distance $D_s$ between the mid-point 69 of the knee cap 20 and the mid-point 28 of the intermediate shell member 24 is configured to increase when the leg pad 10 is worn on the leg 6 of the user and the user bends the knee KJ. As the leg pad 10 increases in length in the knee area, the knee cap 20 is kept in line with the patella and provides a better coverage of the knee KJ for more protection.

The knee cap 20 and the intermediate shell member 24 are rotatable relative to each other about a pivot axis $PA_2$. The pivot axis $PA_2$ is configured to intersect a central portion of the knee KJ of the user when the leg pad 10 is worn on a leg 6 of the user. The pivot axis $PA_2$ is configured to move relative to the intermediate shell member 24 when the knee cap 20 and the intermediate shell member 24 rotate relative to one another. The knee cap 20 and the intermediate shell member 24 have a range of motion of at least 10° without exposing a frontal area of at least one of the knee KJ and the shin SH of the user when the leg pad 10 is worn on the leg 6 of the user. In other embodiments, the range of motion may be at least 15° without exposing a frontal area of at least one of the knee KJ and the shin SH of the user when the leg pad 10 is worn on the leg 6 of the user. In other embodiments, the range of motion of at least 20° without exposing a frontal area of at least one of the knee KJ and the shin SH of the user when the leg pad 10 is worn on the leg 6 of the user.

In this embodiment, the intermediate shell member 24 is movable relative to the upper shell member 22 in response to a flexion motion of the user's knee KJ.

The upper shell member 22 and the intermediate shell member 24 are rotatable relative to one another about a pivot axis $PA_3$. The pivot axis $PA_3$ intersects the medial portion 47 and the lateral portion 48 of the upper shell member 22. The pivot axis $PA_3$ intersects the medial portion 50 and the lateral portion 51 of the intermediate shell member 24.

As best shown in FIGS. 9A and 9B, the movement induced by the flexion movement of the user's knee KJ will cause the intermediate shell member 24 to move from a first position to a second position. As best shown in FIG. 9A, when the intermediate shell member 24 is in the first position, the intermediate shell member 24 may be in an extended position where it extends generally parallel to the longitudinal axis A-A of the leg pad 10 such that the upper shell member 22 and the intermediate shell member 24 are generally straight or rectilinear. As best shown in FIG. 9B, when the intermediate shell member 24 moves from the first position to the second position in response to the flexion motion of the user's knee KJ, the upper shell member 22 and the intermediate shell member 24 pivot about a pivot region $P_\theta$ and defines an angle θ relative to a vertical axis B-B of the leg pad 10. Hence, in the second position, the intermediate shell member 24 may be in a retracted or angled position where it extends along an angle θ relative to the vertical axis B-B. In one embodiment, the angle θ relative to the vertical axis B-B may be up to 10°. In another embodiment, the angle θ relative to the vertical axis B-B may be up to 15°. It is understood that the movement of the intermediate shell member 24 relative to the upper shell member 22 may be a combination of a pivotable movement and a slight translation movement that is allowed, for example, by the stretchability of the band 84 (see the band 84 in the pivot region $P_\theta$).

The leg pad 10 can thus facilitate movement of the user's leg, including bending of the user's knee. For example, in some embodiments, adjacent ones of the knee cap 20, the upper shell member 22, and the intermediate shell member 24 can move relative to one another by respective angles $\theta_1$, $\theta_2$ that collectively can add up to an overall angle $\theta_{total}$ (θ) which emulates natural bending of the user's knee. For example, in some embodiments, $\theta_{total}$ (θ) may be at least 80°, in some cases at least 85° and in some cases at least 90°. In some cases, the respective angles $\theta_1$, $\theta_2$ between adjacent ones of the knee cap 20, the upper shell member 22, and the intermediate shell member 24 may be substantially equal, i.e., in this example each of the respective angles $\theta_1$, $\theta_2$ may be about 45 degrees. In others cases, the respective angles $\theta_1$, $\theta_2$ between adjacent ones of the knee cap 20, the upper shell member 22, and the intermediate shell member 24 may be different. Thus, for example, in some embodiments, each of the respective angles $\theta_1$, $\theta_2$ may be at least 30°, in some cases at least 35°, in some cases at least 40°, and in some cases at least 45°.

Figure 8A:
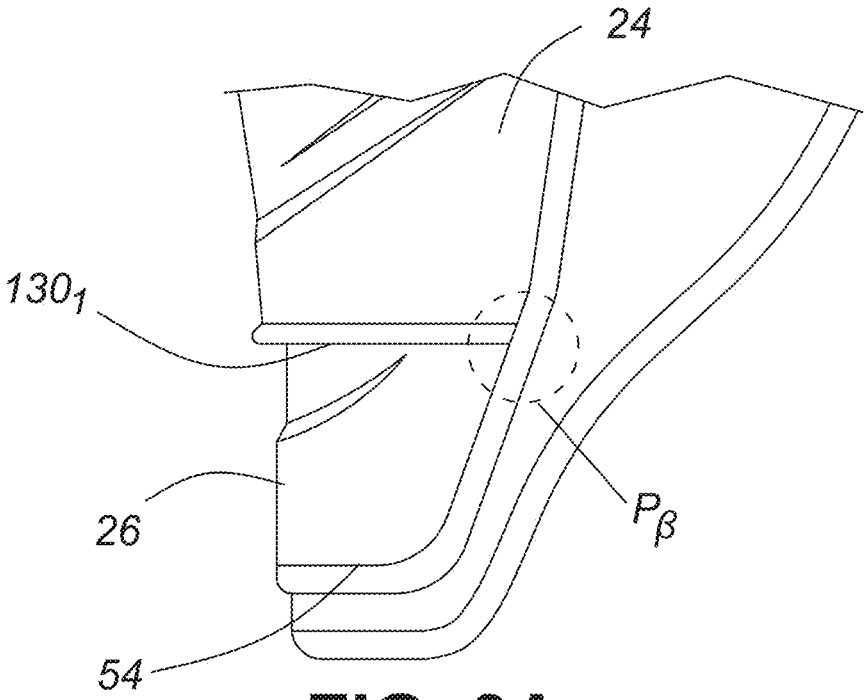
FIG. 8A is an enlarged side view of the shin shell of the leg pad showing a lower shell member in a first position relative to an intermediate shell member.
Figure 8B:
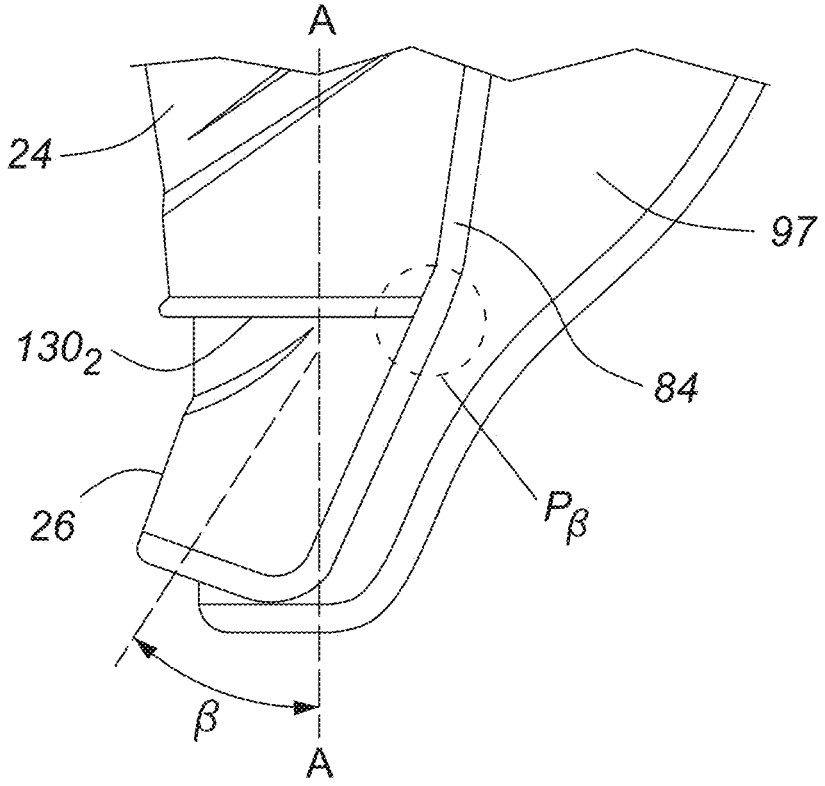
FIG. 8B is an enlarged side view of the shin shell of the leg pad showing the lower shell member in a second position relative to the intermediate shell member.
Figure 10A:
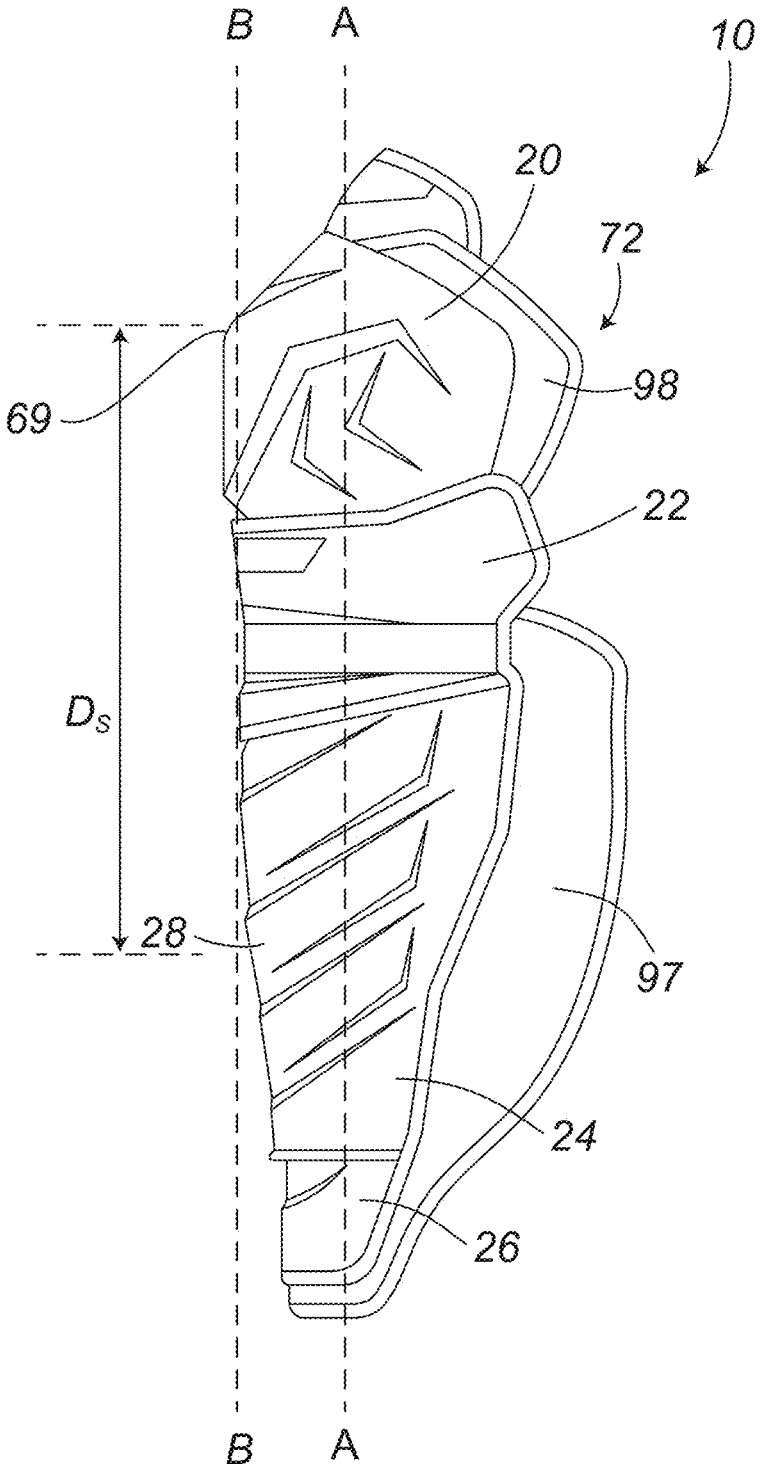
FIG. 10A is a side view of the leg pad showing the shin shell of the leg pad and the lower shell member in the first position.
Figure 10B:
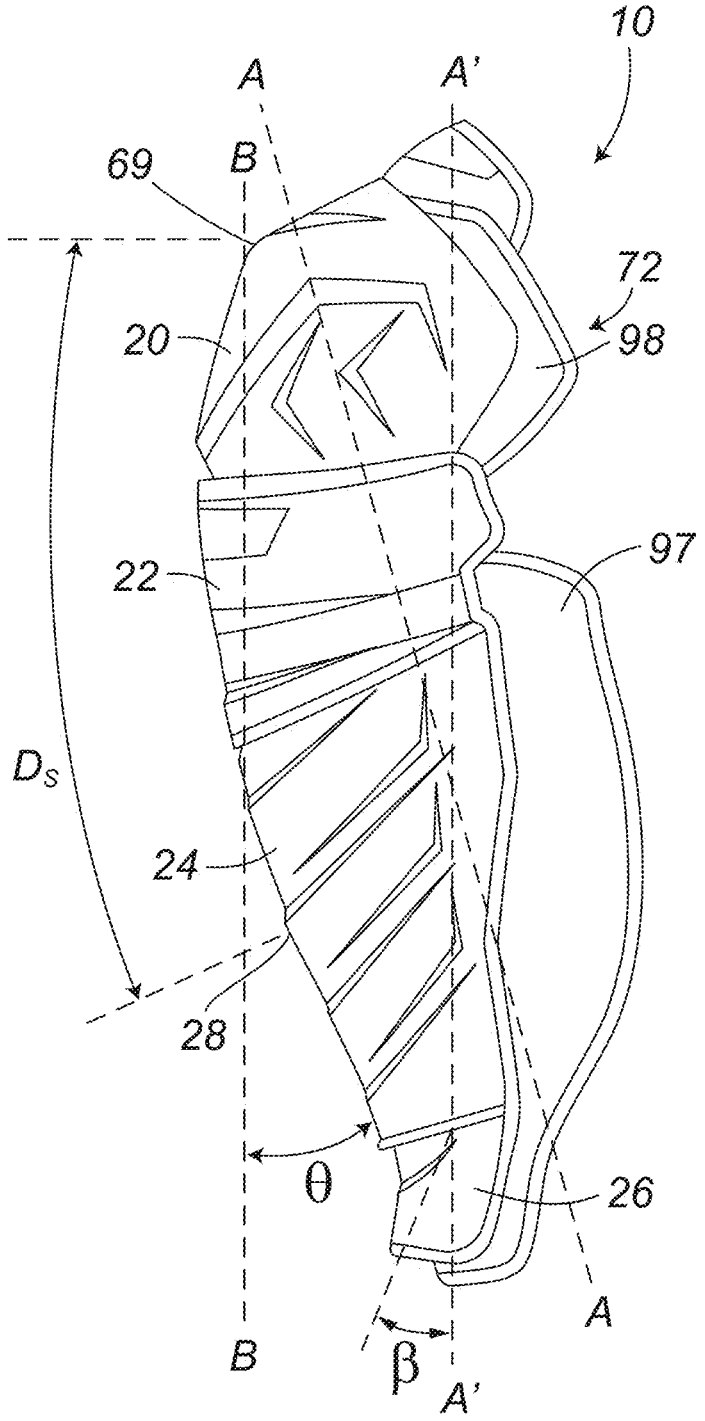
FIG. 10B is a side view of the leg pad showing of the shin shell of the leg pad and the lower shell member in the second position.

In this embodiment, the lower shell member 26 is movable relative to the intermediate shell member 24 in response to a flexion motion of the user's ankle AN. As best shown in FIGS. 8A and 8B, the movement induced by the flexion movement of the user's ankle will cause the lower shell member 26 to move from a first position to a second position. As best shown in FIG. 8A, when the lower shell member 26 is in the first position, the lower shell member 26 may be in an extended position where it extends generally parallel to the longitudinal axis A-A of the leg pad such that the intermediate and lower shell members 24, 26 are generally straight or rectilinear. As best shown in FIGS. 10A and 10B, when the lower shell member 26 moves from the first position to the second position in response to the flexion motion of the user's ankle, the lower shell member 26 then pivots about a pivot region $P_\beta$ and defines an angle β relative to a vertical axis A'-A' of the leg pad 10. Hence, in the second position, the lower shell member 26 may be in a retracted or angled position where it extends along an axis that defines an angle β relative to the vertical axis A'-A'. In one embodiment, the angle β relative to the vertical axis A'-A' may be up to 10°. In another embodiment, the angle β relative to the vertical axis A'-A' may be up to 15°. It is understood that the movement of the lower shell member 26 relative to the intermediate shell member 24 may be a combination of a pivotable movement and a slight translation movement that is allowed, for example, by the stretchability of the band 84 (see the band 84 in the pivot region $P_\beta$).

The upper shell member 22 and the knee cap 20 overlap over an area of overlap 122 which decreases in area when the leg pad 10 is worn on a leg 6 of the user and the user bends the knee KJ. The upper shell member 22 and the intermediate shell member 24 overlap over an area of overlap 120 which decreases in area when the leg pad 10 is worn on a leg 6 of the user and the user bends the knee KJ. The intermediate shell member 24 and the lower shell member 26 overlap over an area of overlap 130 which increases when the leg pad 10 is worn on a leg 6 of the user and the user flexes the ankle AN.

As shown in FIG. 9A, when the intermediate shell member 24 is in the first position, the intermediate and upper shell members 24, 22 are positioned relative to one another to prevent a gap therebetween. More particularly, in the first position, there is an area of overlap 120 between the bottom edge 40 of the upper shell member 22 and the top edge 43 of the intermediate shell member 24. In the first position, the area of overlap 120, when measured along the longitudinal axis A-A, may be between 15 mm and 35 mm. In another embodiment, the area of overlap 120 in the first position may be between 20 mm and 40 mm. When the intermediate shell member 24 is in the second position, as shown in FIG. 9B, the area of overlap 120 in the second position may be between 10 mm and 25 mm as the upper shell member 22 moves relative to the intermediate shell member 24. In another embodiment, the area of overlap 120 in the second position may be between 5 mm and 20 mm in the second position As best shown in FIG. 9B, the bottom edge 40 of the upper shell member 22 overlaps the top edge 43 of the intermediate shell member 24 in order to prevent a gap when the intermediate shell member 24 moves from the second position to the first position.

As shown in FIG. 8A, when the lower shell member 26 is in the first position, the intermediate and lower shell members 24, 26 are positioned relative to one another to prevent a gap therebetween. The intermediate shell member 24 and the lower shell member 26 overlap over an area of overlap 130 which expands when the leg pad is worn on a leg of the user and the user bends the ankle. More particularly, in the first position, there is a first area of overlap 1301 between the bottom edge 44 of the intermediate shell member 24 and the top edge 55 of the lower shell member 26. In the first position, the first area of overlap 1301, when measured along the longitudinal axis A-A, may be between 2 mm and 12 mm. In another embodiment, this first area of overlap 1301 may be between 5 mm and 10 mm. When the lower shell member 26 is in the second position, as shown in FIG. 10B, there is a second area of overlap 1302 between the bottom edge 44 of the intermediate shell member 24 and the top edge 55 of the lower shell member 26, the second area of overlap 1302 being greater than the first area of overlap 1301. In the second position, the second area of overlap 1302, when measured along the longitudinal axis A-A, may be between 5 mm and 20 mm. In another embodiment, this second area of overlap 1302 may be between 15 mm and 20 mm. As best shown in FIGS. 5, 10A and 10B, the bottom edge 44 of the intermediate shell member 24 overlaps the top edge 55 of the lower shell member 26 in order to prevent a gap when the lower shell member 26 moves from the second position to the first position.

In this embodiment, the leg pad 10 provides an enhanced fit with the user's knee KJ and more secure protection to the user's knee KJ from flying pucks or hockey sticks during hockey play. For instance, a connection 90 between the knee cap 20 and the shin shell 21 of the leg pad 10, about the knee KJ and an upper part $SH_U$ of the shin SH of the hockey user, in combination with a connection 91 between the upper shell member 22 and the intermediate shell member 24 of the leg pad 10 may provide enhanced fit and more secure protection.

The connection 90 may comprise a connector 92 for connecting the knee cap 20 and the shin shell 21 of the leg pad 10. More specifically, in this embodiment, the connector 92 may be a connection element 102. In this example, the connection element 102 is mounted under the upper shell member 22 and is adapted to be disposed between the upper shell member 22 and the knee cap 20. As shown in FIGS. 3A and 4B, in this embodiment, the connection element 102 comprises an outer side 103 and an inner side 105, the outer side 103 being opposed to the inner side 105. Also, in this embodiment, the connection element 102 comprises a top edge 106, a bottom edge 107, a medial edge 108 and a lateral edge 109. The outer side 103 of the connection element 102 faces the inner side 34 of upper shell member 22. The inner side 105 of the connection element 102 faces the outer side 30 of knee cap 20. The top edge 106 of the connection element 102 is generally aligned with the top edge 39 of the upper shell member 22. The bottom edge 107 of the connection element 102 is generally aligned with the bottom edge 65 of the knee cap 20.

The connection element 102 may be made of any suitable material or composition or materials that is desired. The connection element 102 may be made of a soft material such as foam, polyethylene, low density polyethylene (LDPE) or any other suitable material. The connection element 102 may also be made of foam material covered by layers of woven synthetic yarn, such as closed cell foam of ethylene vinyl acetate covered by a mesh outer layer of a woven synthetic material such as polyester. Such materials would conform itself to the anatomy of the user and may dampen any blows that might occur on upper shell member 22. It is understood that the connection element 102 may be omitted if the upper shell member 22 is made, for example, of a rigid outer layer and a soft inner layer affixed to the rigid outer layer.

In this embodiment, a band 104 extends along part of a periphery of the connection element 102. In some embodiments, the band 104 extends along the entire periphery of the connection element 102. In other embodiments, the band 104 may extend along a portion (i.e. less than an entirety) of the periphery of the connection element 102.

The band 104 may be a strip of fabric such as a woven stretchable fabric. The band 104 may also be a braiding.

The band 104 may have a width large enough to cover at least partially the outer and inner sides and edges of the connection element 102. As shown in FIG. 3A, the band 104 is wide enough to cover a portion of the outer and inner sides 103, 105 and the top, bottom, medial and lateral edges 106, 107, 108, 109 of the connection element 102.

The leg pad 10 may comprise a stitching line 93 passing through the band 104 and the band 84 and passing through the band 84 and the connection element 102 in order to affix the connection element 102 to the upper shell member 22 such that the band 104 interconnects the connection element 102 and the upper shell member 22.

It is however understood that the affixation of the band 104 to the upper shell member 22 and the connection element 102 is not limited to such stitching. For example, in another embodiment, the band 104 may be affixed to the upper shell member 22 and the connection element 102 via an adhesive or any other affixing means known in the art.

The knee cap 20 of the leg pad 10 is mounted under the shin shell 21 of the leg pad 10 in two distinct points located along the pivot axis PA of the shin shell 21 relative to the knee cap 20 to allow the knee cap 20 and the shin shell 21 of the leg pad 10 to move between a first and a second position in response to the bending of the knee KJ.

The leg pad 10 may also comprise a plurality of stitching lines 811, 812 passing through the connection element 102 and the liner member 98 and passing through the band 84 and the connection element 102 in order in order to affix the assembled knee cap 20 and the upper shell member 22 such that the stitching 81 interconnects the knee cap 20 to upper shell member 22. Stitching line 811 may pass through the lateral edge 109 of connection element 102 and the lateral edge 80 of liner member 98 and pass through the band 84 and the lateral edge 109 of connection element 102. Stitching line 812 may pass through the medial edge 108 of connection element 102 and the medial edge 79 of liner member 98 and pass through the band 84 and the medial edge 108 of connection element 102.

The stitching lines 811, 812 allow the knee cap 20 to move relative to the shin shell 21. The stitching lines 811, 812 allow the knee cap 20 and the shin shell 21 to be rotatable relative to one another about a pivot axis PA. The knee cap 20 and the upper shell member 22 are rotatable relative to one another about the pivot axis $PA_1$. The pivot axis $PA_1$ intersects the medial portion 61 and the lateral portion 62 of the knee cap 20. The pivot axis $PA_1$ intersects the medial portion 47 and the lateral portion 48 of the upper shell member 22. The pivot axis $PA_1$ is such that it is in line with the natural pivotal axis of the knee.

The stitching lines 811, 812 create a pivot axis PA which intersects the medial portion 61 and the lateral portion 62 of the knee cap 20. The stitching lines 811, 812 create a pivot axis PA which intersects a medial portion 11 and a lateral portion 12 of the shin shell 21.

Figure 12:
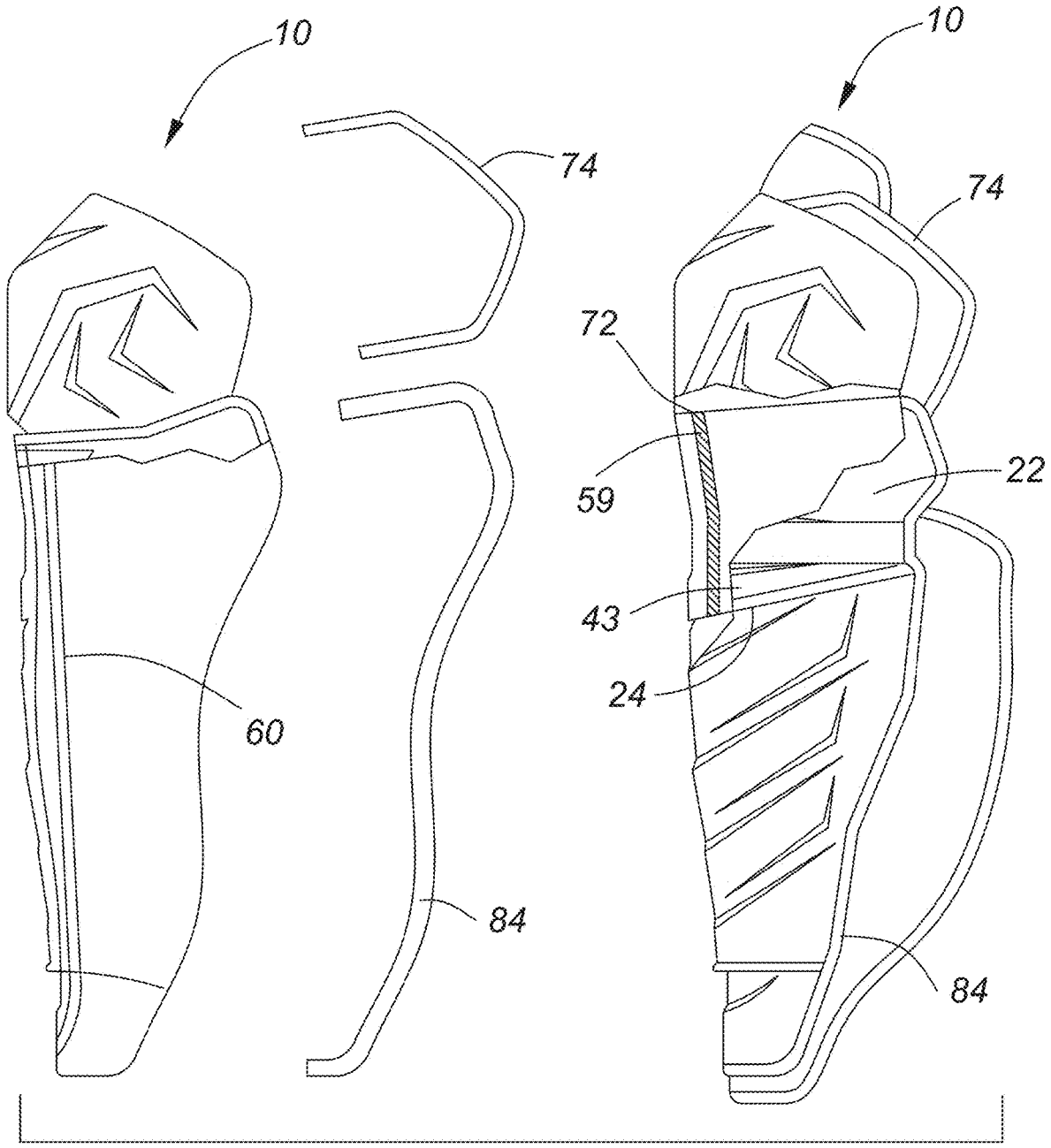
FIG. 12 is a cross-sectional view showing the upper, intermediate and lower shell members of the shin shell, a side exploded view of the leg pad and a cross-sectional view showing the upper shell member.
Figure 13:
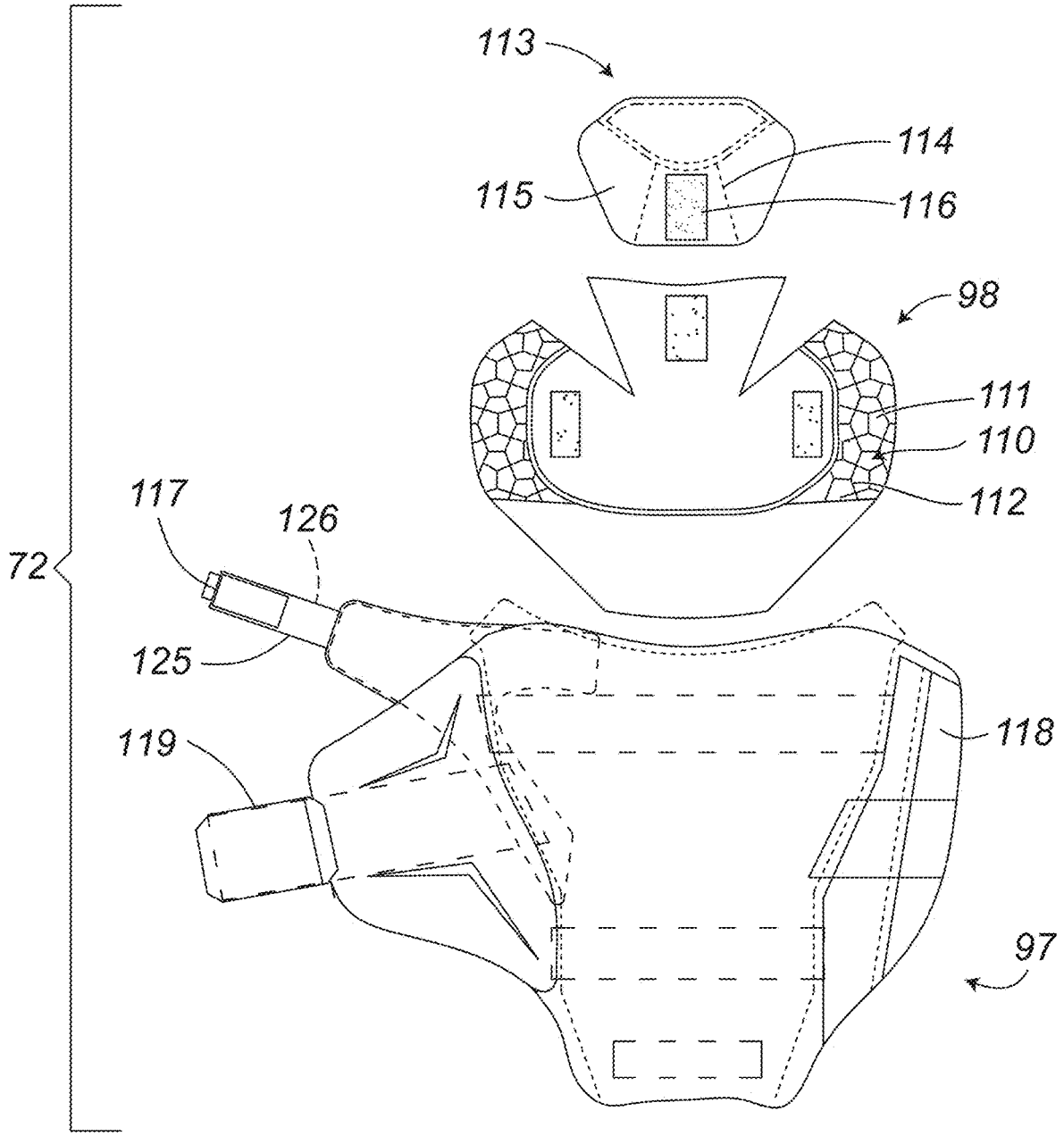
FIG. 13 is a front exploded view of the leg pad showing liner members.

As best shown in FIG. 12, the leg pad 10 may comprise a strap 59 which connects the upper shell member 22 and the intermediate shell member 24. The strap 59 may be connected to the inner sides 34, 36 of the upper and intermediate shell members 22, 24. In one embodiment, the strap 59 may be connected to the top edges 39, 43 of the upper and intermediate shell members 22, 24. The strap 59 may restrict the top edge 43 of the intermediate shell member 24 from moving over the bottom edge 40 of the upper shell member 22. The strap 59 may also ensure that the intermediate shell member 24 remains generally parallel to the longitudinal axis A-A of the leg pad 10 when pressure is applied on the intermediate shell member 24 for moving/pivoting the intermediate shell member 24 outwardly (for example, in response to the flexion of the knee).

As best shown in FIG. 12, the leg pad 10 may comprise a strap 60 which connects the knee cap 20 and the shin shell 21. The strap 60 may be connected to the liner member 98 and the inner side 38 of the lower shell member 26. In one embodiment, the strap 60 may be connected to the bottom edge 78 of liner member 98 and the top edge 55 of lower shell member 26. The strap 60 may restrict the top edge 55 of the lower shell member 26 from moving over the bottom edge 44 of the intermediate shell member 24. The strap 60 may also ensure that the lower shell member 26 remains generally parallel to the longitudinal axis A-A of the leg pad 10 when pressure is applied on the intermediate shell member 24 for moving/pivoting the intermediate shell member 24 inwardly (for example, in a direction towards a user's ankle).

As shown in FIG. 9A, when the intermediate shell member 24 is in the first position, liner members 98 and 97 are positioned relative to one another to prevent a gap therebetween. This may prevent any gap between the liner members 98 and 97 between the first and second position in response to the bending of the knee. More particularly, in the first position, there is an overlap between the bottom edge 78 of the liner member 98 and the top edge 86 of the liner member 97. In the first position, the area of overlap 123, when measured along the longitudinal axis A-A, may be between 25 mm and 50 mm. In another embodiment, the area of overlap 123 in the first position may be between 30 mm and 60 mm. When the intermediate shell member 24 is in the second position, as shown in FIG. 9B, the area of overlap 123 in the second position may be between 15 mm and 40 mm as the knee cap 20 moves relative to the shin shell 21. In another embodiment, the area of overlap 123 in the second position may be between 10 mm and 35 mm in the second position. As best shown in FIG. 9B, the top edge 86 of liner member 97 overlaps the bottom edge 78 of the liner member 98 in order to prevent a gap when the intermediate shell member 24 moves from the second position to the first position.

The leg pad 10 may be implemented in various other ways in other embodiments. For example, in some embodiments, the knee cap 20 may also comprise knee wings 110. The knee wings 110 may further protect the lateral portion of the knee KJ. The knee wings 110 may comprise a foam insert 111. The knee wings 110 may further comprise a base foam 112. The base foam 112 and the foam insert 111 may be covered by a suitable material. The suitable material may be mesh. The knee wings 110 may also comprise a binding with stitching.

In another embodiment, the knee cap 20 may comprise a thigh guard 113. The thigh guard 113 may further protect the lateral portion of the leg 6 of the sport's user. The thigh guard 113 may be covered with fabric. The thigh guard 113 may comprise an insert 114. The insert 114 may be made of foam. The foam may be high-density (HD). The foam insert may be pre-curved such that it better conforms to the leg 6 of the sports user. The thigh guard 113 may comprise a liner and binding.

The thigh guard 113 may also include a gusset 115. The gusset 115 may be used for affixing the thigh guard 113 to the knee cap 20. The gusset 115 may be affixed to the liner member 98. The thigh guard may have a liner. The thigh guard liner may have a Velcro® hook. The liner member 98 may have a Velcro® loop. The thigh guard 113 may be further affixed to the liner with the aid of the Velcro® hook and loop.

The liner member 98 may further comprise a knee cap liner 116. The knee cap liner 116 is configured to provide additional protection to the knee KJ. The knee cap liner 116 may cover a portion of the patella. The knee cap liner 116 may be comprised of a sheet, base foam, a foam insert and a backing. The backing may be made of nylon.

In another embodiment, the leg pad 10 may comprise a shin strap 117. The shin strap 117 may be attached to the liner member 97. The shin strap 117 may comprise an outer side 125 and an inner side 126. The shin strap 117 may be used to further secure the leg pad 10 to the leg 6 of the user.

In another embodiment, the leg pad may comprise a calf guard 118. The calf guard 118 may provide additional protection to the back of the shin SH. The calf guard 118 may be secured using a calf wrap strap 119.

Although in embodiments considered above the leg pad 10 is a hockey leg pad, in other embodiments, the leg pad 10 may be any other leg pad usable in another type of contact sport (e.g., a "full-contact" sport) in which there are significant impact forces on the user due to user-to-user and/or user-to-object contact or any other type of sports, including athletic activities other than contact sports. For example, in other embodiments, the leg pad 10 may be a lacrosse leg pad.

Although various embodiments have been illustrated, this was for purposes of describing, but should not be limiting. Various changes, modifications and enhancements may be made.

The invention claimed is:

1. A leg pad for protecting a leg of a user, the leg pad comprising:

a knee cap configured to cover at least part of a knee of the user;

a shin shell configured to cover at least part of a shin of the user, movable relative to the knee cap, and comprising shell members that are rigid, disposed adjacent to one another in a longitudinal direction of the leg pad, and movable relative to one another when the leg of the user bends and extends;

wherein: when the knee of the user bends and an ankle of the user flexes, a first one of the shell member and a second one of the shell members are movable relative to one another in an upper half of the shin shell in accordance with bending of the knee of the user and the second one of the shell members and a third one of the shell members are movable relative to one another in a lower half of the shin shell in accordance with flexing of the ankle of the user an overlap between the first one of the shell members and the second one of the shell members is configured to decrease when the knee of the user bends; and an overlap between the second one of the shell members and the third one of the shell members is configured to increase when the knee of the user bends and the ankle of the user flexes.

2. The leg pad of claim 1, wherein the first one of the shell members and the second one of the shell members movable relative to one another in the upper half of the shin shell in accordance with the bending of the knee of the user and the second one of the shell members and the third one of the shell members movable relative to one another in the lower half of the shin shell in accordance with the flexing of the ankle of the user are configured such that the knee cap remains over a patella of the knee of the user when the knee of the user bends.

3. The leg pad of claim 1, wherein the upper half of the shin shell is configured to extend when the knee of the user bends, independent of movement of the ankle of the user.

4. The leg pad of claim 1, wherein: the first one of the shell members and the second one of the shell members are configured to avoid an exposed gap therebetween over a range of relative motion thereof; and the second one of the shell members and the third one of the shell members are configured to avoid an exposed gap therebetween over a range of relative motion thereof.

5. The leg pad of claim 1, wherein: the first one of the shell members is biased towards a rest position relative to the second one of the shell members; and the third one of the shell members is biased towards a rest position relative to the second one of the shell members.

6. The leg pad of claim 1, comprising a liner disposed behind the shin shell.

7. The leg pad of claim 6, wherein the liner extends across adjacent ones of the shell members.

8. The leg pad of claim 1, comprising a band disposed about at least part of a periphery of the first one of the shell members and the second one of the shell members to interconnect the first one of the shell members and the second one of the shell members and allow the first one of the shell members and the second one of the shell members to move relative to one another.

9. The leg pad of claim 1, comprising a band disposed about at least part of a periphery of the first one of the shell members, at least part of a periphery of the second one of the shell members and at least part of a periphery of the third one of the shell members to interconnect the first one of the shell members, the second one of the shell members and the third one of the shell members and allow the first one of the shell members, the second one of the shell members, and the third one of the shell members to move relative to one another.

10. The leg pad of claim 1, comprising at least one band disposed about at least part of a periphery of the first one of the shell members, at least part of a periphery of the second one of the shell members and at least part of a periphery of the third one of the shell members to interconnect the first one of the shell members, the second one of the shell members and the third one of the shell members and allow the first one of the shell members, the second one of the shell members and the third one of the shell members to move relative to one another.

11. The leg pad of claim 10, wherein the at least one band is a single band.

12. A leg pad for protecting a leg of a user, the leg pad extending along a longitudinal axis and comprising:

a) a knee cap configured to cover at least part of a knee of the user, the knee cap comprising an upper end, a lower end, and a mid-point located between the upper end and the lower end of the knee cap, the knee cap being curved between the upper end of the knee cap and the lower end of the knee cap such that the mid-point of the knee cap projects forwardly relative to the upper end of the knee cap and the lower end of the knee cap in a longitudinal direction of the leg pad; and b) a shin shell configured to cover at least part of a shin of the user, the shin shell comprising an upper end, a lower end and a mid-point located between the upper end of the shin shell and the lower end of the shin shell;

wherein: the shin shell comprises shell members that are rigid, disposed adjacent to one another in a longitudinal direction of the leg pad, and movable relative to one another when the leg of the user bends and extends; a first one of the shell members and a second one of the shell members are movable relative to one another in an upper half of the shin shell; the second one of the shell members and a third one of the shell members are movable relative to one another in a lower half of the shin shell; an overlap between the first one of the shell members and the second one of the shell members is configured to decrease when the knee of the user bends; an overlap between the second one of the shell members and the third one of the shell members is configured to increase when the knee of the user bends and an ankle of the user flexes; the knee cap and the shin shell are movable relative to each other when the leg of the user bends and extends; and the upper end of the shin shell and the mid-point of the shin shell are configured to be movable relative to one another when the leg of the user bends and extends.

13. A leg pad for protecting a leg of a user, the leg pad comprising:

a knee cap configured to cover at least part of a knee of the user; and a shin shell configured to cover at least part of a shin of the user, movable relative to the knee cap, and comprising shell members that are rigid, disposed adjacent to one another in a longitudinal direction of the leg pad, and movable relative to one another when the leg of the user bends and extends;

wherein: when the knee of the user bends and an ankle of the user flexes, a first one of the shell members and a second one of the shell members are movable relative to one another in an upper half of the shin shell in accordance with bending of the knee of the user and the second one of the shell members and a third one of the shell members are movable relative to one another in a lower half of the shin shell in accordance with flexing of the ankle of the user; the first one of the shell members and the second one of the shell members are configured to avoid an exposed gap therebetween over a range of relative motion thereof; and the second one of the shell members and the third one of the shell members are configured to avoid an exposed gap therebetween over a range of relative motion thereof.

* * * * *